US012134490B2

(12) United States Patent
Clouser et al.

(10) Patent No.: US 12,134,490 B2
(45) Date of Patent: Nov. 5, 2024

(54) SYSTEM AND METHOD FOR BLISTER PACKAGING

(71) Applicant: Gary L. Sharpe, Naples, FL (US)

(72) Inventors: Doug Clouser, Lewis Center, OH (US); Gayle Watkins, Grove City, OH (US)

(73) Assignee: Gary L. Sharpe, Naples, FL (US)

( * ) Notice: Subject to any disclaimer, the term of this patent is extended or adjusted under 35 U.S.C. 154(b) by 112 days.

(21) Appl. No.: 17/689,486

(22) Filed: Mar. 8, 2022

(65) Prior Publication Data

US 2023/0286685 A1 Sep. 14, 2023

(51) Int. Cl.

| | |
|---|---|
| ***B65B 11/50*** | (2006.01) |
| ***B65B 9/04*** | (2006.01) |
| ***B65D 75/32*** | (2006.01) |

(52) U.S. Cl.

CPC ..... *B65B 11/50* (2013.01); *B65B 9/045* (2013.01); *B65D 75/323* (2013.01)

(58) Field of Classification Search

CPC ..... B65B 11/50; B65B 9/045; B65D 75/323

USPC ..... 53/452

See application file for complete search history.

(56) References Cited

U.S. PATENT DOCUMENTS

| | | | | |
|---|---|---|---|---|
| 4,429,792 | A * | 2/1984 | Machbitz | B65D 75/327 206/532 |
| 5,788,079 | A * | 8/1998 | Bouthiette | A61J 7/0069 206/534 |
| 7,802,683 | B2 * | 9/2010 | Bourque | A61J 7/0069 206/534 |
| 9,963,265 | B1 * | 5/2018 | Braverman | B65D 77/22 |
| 10,259,613 | B2 | 4/2019 | Braverman et al. | |
| 10,994,891 | B2 | 5/2021 | Braverman et al. | |
| 2021/0229862 | A1 | 7/2021 | Braverman et al. | |
| 2021/0284415 | A1 | 9/2021 | Braverman et al. | |

FOREIGN PATENT DOCUMENTS

| | | | |
|---|---|---|---|
| CA | 3061195 | A1 | 11/2018 |
| EP | 3601088 | A1 | 2/2020 |

* cited by examiner

*Primary Examiner* — Robert F Long
*Assistant Examiner* — Xavier A Madison
(74) *Attorney, Agent, or Firm* — Standley Law Group LLP; Jeffrey S. Standley; Beverly A. Marsh

(57) ABSTRACT

Devices, systems, and methods for blister packaging are disclosed. An assembly utilizing interchangeable inserts allows for a variety of blister packaging to be sealed with corresponding labels that are anchored into proper orientation through the use of locator pins. Blisters are nested into inserts and held in a fixed position while label sheets having holes for receiving locator pins are inserted onto the assembly. Visual indicators on labels identify pull flaps, and tear slits provide evidence of tampering with packaged blisters.

10 Claims, 31 Drawing Sheets

SYSTEM AND METHOD FOR BLISTER PACKAGING

TECHNICAL FIELD

Embodiments of the present invention relate to blister packaging. More particularly, embodiments relate to systems and methods for manufacturing and packaging blister packs.

BACKGROUND

In hospital and clinical settings, there is a never ending need to package pills and other items into single-use blister packs. Commonly prescribed drugs such as pain killers, anti-inflammatories, statins, steroids, ACE inhibitors, hormones, anti-diabetic medications, beta blockers, calcium channel blockers, heartburn medication, antibiotics, and others may be purchased in bulk quantities by hospital and clinics, and subsequently prepared for later use by placing small amounts into individual unit-dose packaging. A variety of pills, capsules, tablets, or lozenges may be packaged into blister packs. Blister packaging typically involves placing medication into a pre-formed cavity or pocket, and sealing the medication into the cavity or pocket cell by placing a label over the opening of the cavity or pocket, and sealing the label to the top of the cavity or pocket. The resulting blister pack can keep contents clean and protected from environmental factors such as moisture, and otherwise help to maintain shelf life of the contents until the time at which the blister pack is opened and the contents dispensed to a patient.

Filling and sealing blister packs may be performed by a pharmacy technician, nurse, or other staff. It may be performed in-house, such as in a hospital's own pharmacy department, or it may be performed by an outside pharmacy or other vendor involved with supplying medication. In many settings, the filling and sealing of blister packs is performed on a daily basis in order to keep up with the continuous need for unit-dose medication dispensed to patients, as well as to create a sufficient back supply of unit-dose medication. Filled blister packs may be stored for days, weeks, months, or even longer until they are used.

In order to save time in creating sealed blisters, blister packs may be formed as part of a larger array of blister packs. For example, multiple pre-formed cavities or pockets that are connected to one another may be filled with contents and sealed with labels at the same time. Individual blister packs can subsequently be separated from one another as desired by a user. However, packaging blisters, whether individually or as part of an array, presents various difficulties. Pharmacy technicians or other persons tasked with packaging often have to visually gauge how to properly position label or labels over the blister or blisters, as well as have very steady hands, in order to properly line up each label and corresponding blister to ensure that a proper seal is achieved. They also have to know how to properly orient the labels with respect to the blister. That is, which side of the label or labels is to be matched up with which side of a blister or blisters. The inherent difficulty in visually trying to position and line up blisters with labels as well as the difficulty in having steady hands, often results in mistakes. Labels may be offset from their intended location and orientation on a blister, which may impede the ability of a later user to peel or otherwise remove the label and access the contents of the blister pack when desired. Improper label placement may prevent a full seal around the perimeter of the cavity or pocket from being achieved, in turn allowing moisture or other environmental factors to negatively impact the shelf life and/or efficacy of the contents. Adhesive located on the bottom surface of an improperly positioned label may touch the contents of the blister pack, making the contents undesirable for use. Improperly positioned labels may also make it difficult to separate individual blister packs from one another. Trying to orient labels in the correct position, and visually lining up labels with blisters also results in a slow process, making it very time intensive to fill a large amount of blister packs.

Another difficulty in blister packaging is that there are often a variety of different blister shapes and sizes, and each may have a different corresponding label. Pharmacy technicians may have to switch from packaging a variety of different types of blisters, further increasing the chance for mistakes.

SUMMARY OF THE INVENTION

Accordingly, exemplary embodiments of the present invention have been made to remedy the previous mentioned problems. In an exemplary embodiment, a system or assembly for packaging blister labels includes a base. The base comprises a top side with a top surface having an inner perimeter and a bottom side, a central opening, and a recessed shelf surrounding at least a portion of the central opening. The recessed shelf is located between the inner perimeter of the top surface and an opening perimeter. The base may be generally rectangular with a central opening that is generally rectangular. The base also comprises a pair of locator pins that extend outward from the top surface of the base. The base may have a plurality of feet extending from its bottom surface, and in an exemplary embodiment may have one foot located at each corner. The base may have protrusions extending outward from one or more corners.

The system or assembly further includes an insert having a generally planar body. The insert has a plurality of openings through its planar body, and the openings may be oriented in an array of columns and rows. The overall size and shape of the insert may allow it to be removably placed onto the recessed shelf of the base, and cover the central opening of the base when it is placed on the shelf. The insert may have a generally rectangular shape. The depth of the recessed shelf of the base, and the thickness of the planar insert body may be such that when the insert is placed into the base, the top surface of the insert and the top surface of the base are even and form a continuous plane. The insert may be uniform on both sides so that either side can be inserted down into the base.

The system may include a plurality of inserts that can be used interchangeably with the base. Each insert may have a different array of openings through its body, with the openings on each insert corresponding to the blister cavities on a blister pack array.

In an exemplary embodiment, a blister pack array is comprised of a plurality of individual blisters that may be arranged in rows and columns. Each individual blister comprises a blister cavity for receiving one or more items, which is surrounded by a shelf. The blister cavities may be uniform in size, shape, and orientation on each individual blister. The perimeter of each individual blister may be perforated along an outer perimeter such that individual blisters can be separated from neighboring blisters. In an exemplary embodiment, a label sheet may correspond to a blister pack array. The label sheet may have a blister portion comprising a plurality of individual labels, and an outer frame portion. The blister portion may have a perforated outer perimeter that allows the blister portion to be separated from the outer frame portion. The label sheet may have two locator holes that correspond in size and orientation to the size and orientation of the locator pins on a base. The locator holes may allow the locator pins to be inserted through the label sheet, thereby anchoring the label sheet in a fixed position relative to the base, an insert resting in the base, and any one or more blisters that are nested in the insert.

The label sheet may have a removable back portion which, when removed, may cause exposure of the back surfaces of the individual labels. The back surface of each of the individual labels may comprise a central bare portion and an adhesive portion. The central bare portion may align with the blister cavity of a corresponding blister, and the adhesive portion may align with the shelf of the corresponding blister. The back surface of each individual label may also include a bare corner portion to aid in a user's ability to remove the label from a blister after packaging. The labels may have one or more visual indicators on their front surface. Visual indicators may identify the location of the bare corner portion, or may provide information about the contents of a packaged blister, or information about the blister itself. The top surface of the labels may also be printed with information which may include bar codes. In an exemplary embodiment, the labels may include one or more tear propagation slits. The label sheet may comprise one or more appendix labels. In an exemplary embodiment, the label sheet may be generally comprised of a paper-foil face and a paper line, with an adhesive film located in between. In other exemplary embodiments, the label sheet may be comprised of any variety of layers and materials that inhibit or reduce the permeation of moisture in or out of a packaged blister. In an exemplary embodiment, various label sheets with individual labels that correspond in number, size, and shape, to different blister pack arrays are provided in order to permit packaging of various sizes and shapes of items.

In an exemplary embodiment, a method of packaging blisters comprises the steps of obtaining a base, obtaining a blister pack array, selecting an insert that corresponds to the obtained blister pack array, nesting the blister pack into the insert, after the insert has been placed into the recessed shelf in the central opening of the base, and ensuring that any desired contents are placed into the individual blister cavities, obtaining a selected label sheet, where the label sheet corresponds to the blister pack array, anchoring the label sheet into a fixed orientation relative to the base and insert by inserting the locator pins on the base through the locator holes on the label sheet, removing the back portion of the label sheet such that the adhesive portions on the back surfaces of the individual labels are exposed, placing the label sheet on top of the blister pack array, applying downward pressure to the top surface of the label sheet to bond the individual labels to the individual blisters and forming a packaged blister array, removing the outer frame portion from the packaged blister array by pulling upwards on the outer frame portion and causing a separation along the perforated perimeter, and removing the packaged blister array from the insert. Subsequently, the packaged blister array may be separated into individual packaged blisters. The method of applying pressure may be done manually or through the use of a tool.

In an exemplary embodiment, the blister pack arrays are thermoformed using a female tool, thereby avoiding contact between any release agents used in the molding process and the top surface of the shelves surrounding each blister, and optimizing the potential for bonding between the top surface of the shelf and the adhesive portions on the individual labels.

BRIEF DESCRIPTION OF THE DRAWINGS

Novel features and advantages of the present invention, in addition to those expressly mentioned herein, will become apparent to those skilled in the art from a reading of the following detailed description in conjunction with the accompanying drawings. The present disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Figure 1:
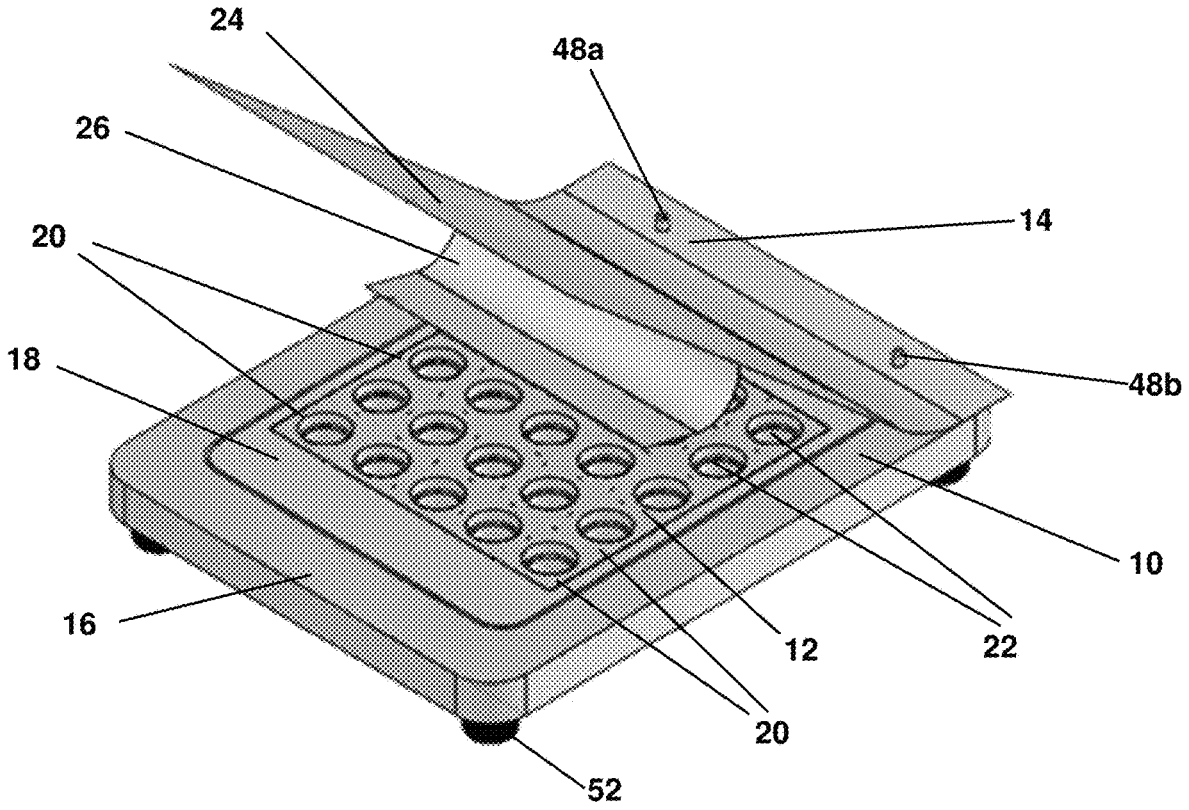
FIG. 1 is a front perspective view of an exemplary embodiment of a base and insert assembly in use with an exemplary embodiment of a blister array and an exemplary embodiment of a label sheet.

Referring to FIG. 1, an assembly 10 according to an exemplary embodiment is shown in use with an exemplary embodiment of a blister pack array 12 and an exemplary embodiment of a label sheet 14. The assembly 10 is comprised of a base 16 and an insert 18 removably located inside the base 16. The blister pack array 12 is positioned on the insert 18. The blister pack array 12 contains multiple blisters 20, each blister 20 comprising a round cavity 22. The label sheet 14 is comprised of a front sheet 24 and a removable back cover 26. In FIG. 1, the removable back cover 26 is illustrated as partially peeled away from the front sheet 24. As further described below, the removable back cover 26 may be fully removed from the remainder of the label sheet 14 in order to allow a portion of the front sheet 24 to be secured to the blister pack array 12.

Referring to FIGS. 2-5, the base 16 is shown in further detail. The base 16 is generally rectangular in shape with a top side 28, a bottom side 30, a front surface 32, and a back surface 34. The front surface 32 is defined by an outer perimeter 36 and an inner perimeter 38. A central opening 40 in the base 16 is defined by a recessed shelf 42 located between the inner perimeter 38 of the front surface 32 and an opening perimeter 44. The recessed shelf 42 has a top surface 46.

Located at the top side 28 of the base 16 are a pair of locator pins 48*a*, 48*b* extending outward from the front surface 32. The size, shape, and spacing of the locator pins 48*a*, 48*b* may correspond to the size, shape, and spacing of a pair of holes in a label sheet, and used to guide a label sheet into a desired position relative to a blister pack array held by the assembly. The locator pins 48*a*, 48*b*, may also help anchor a label sheet in place while a user is working to secure the label sheet to a blister pack array. In the exemplary embodiment of FIG. 2, the locator pins 48*a*, 48*b* are circular in shape, approximately ¼ inches tall, 3/16 inches in diameter, and spaced 5 inches apart from one another. Of course, in other exemplary embodiments, a variety of locator pin shapes, sizes, and spacing may be used. Other exemplary embodiments may use a single locator pin, a plurality of locating pins, or another type of locating feature for anchoring a label sheet into a desired position relative to a blister pack array. In some exemplary embodiments, one or more ridges located on the top surface of the base could also be used in combination with, or in lieu of any locator pins to guide the correct positioning of a label sheet. For example, one or more ridges placed on the top surface of the base could control the outside edge(s) of the label sheet and hold a label sheet in the correct position relative to a blister pack held by an assembly.

Figure 2:
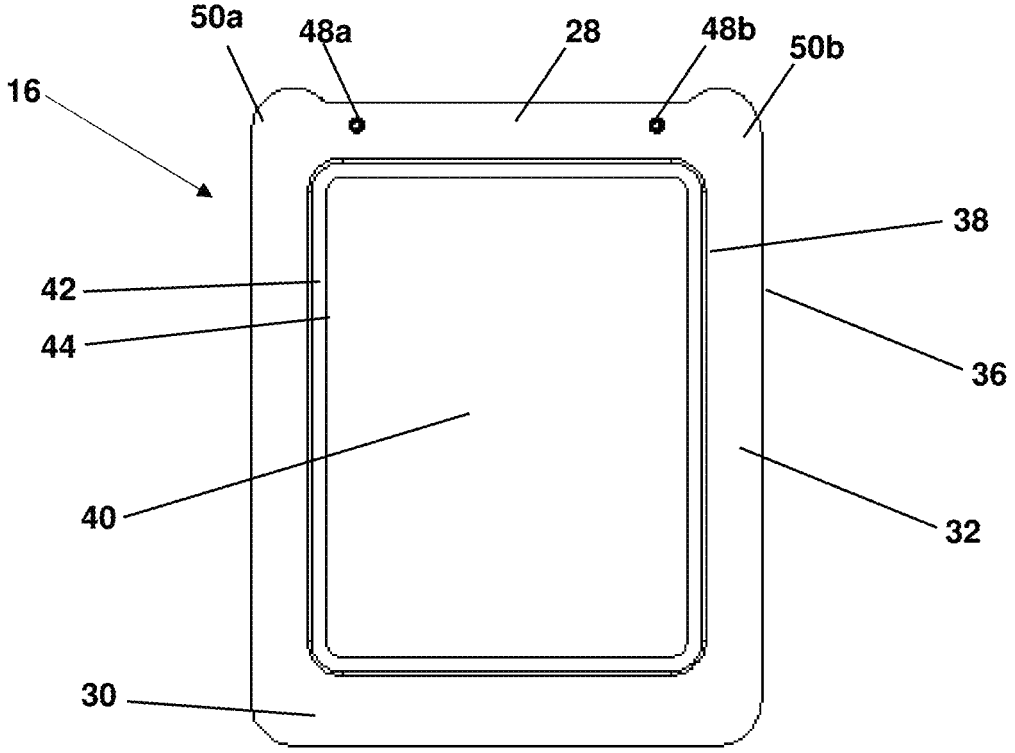
FIG. 2 is a top plan view of an exemplary embodiment of a base.
Figure 3:
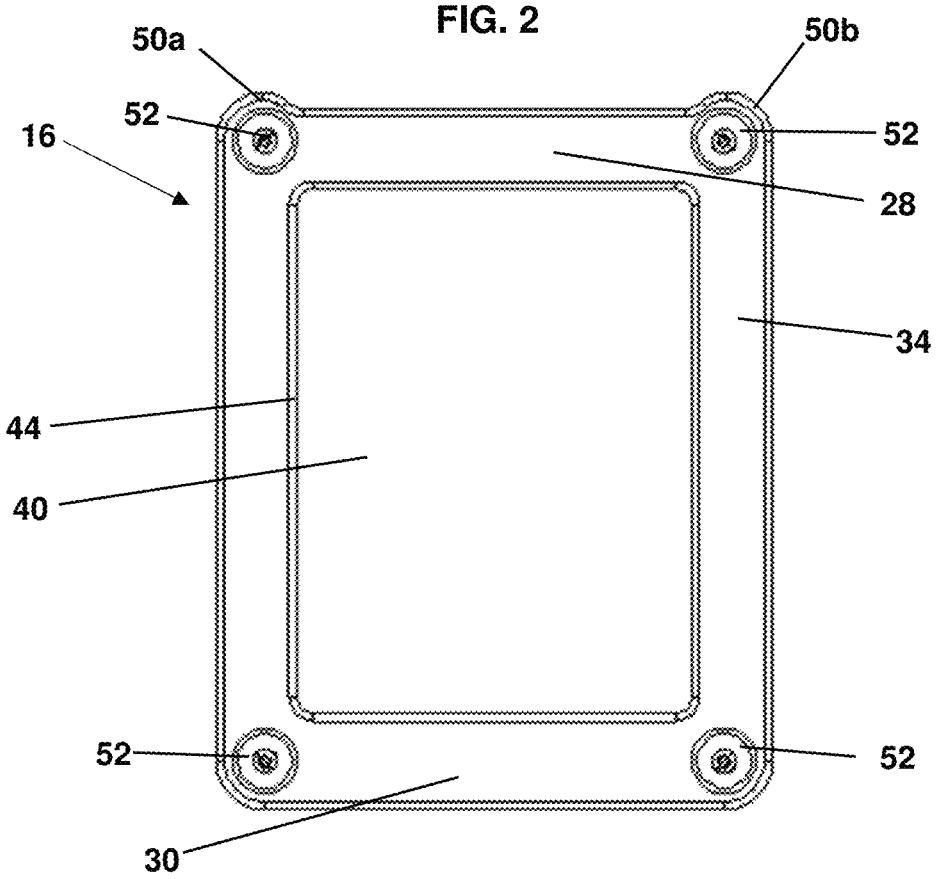
FIG. 3 is a bottom plan view of the base of FIG. 2.
Figure 4:
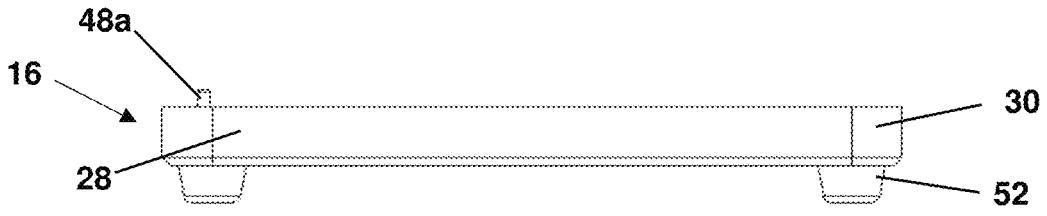
FIG. 4 is a left side elevational view of the base of FIG. 2.
Figure 5:
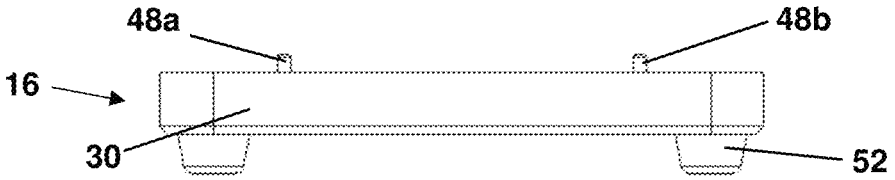
FIG. 5 is a bottom side elevational view of the base of FIG. 2.

As shown in FIGS. 2 and 3, rounded protrusions 50*a*, 50*b* extend from the two top neighboring corners of the base 16. These protrusions 50*a*, 50*b* may serve as bumpers if a user pushes the assembly against a wall or other vertical surface, ensuring that a certain amount of distance exists between the locator pins and the wall or other vertical surface, so as to give a user enough space to maneuver a label sheet on and off the locator pins. As shown in FIGS. 2 and 3, the locator pins may be located in-between the neighboring corners from which the rounded protrusions extend. In other exemplary embodiments, the protrusions may be of different shapes or sizes, and be located in different locations relative to the rounded protrusions. In still other exemplary embodiments, there may be no protrusions, or there may be protrusions at each of the four corners of the base.

On the bottom side of the base, near each of the four corners, feet 52 are located. In an exemplary embodiment, the feet 52 are circular, approximately 25/32 inches high, and 25/32 inches in diameter. Of course, in other exemplary embodiments, the feet 52 may be of different shapes and sizes, located in different locations, or there may be no feet 52 at all. In an exemplary embodiment, it may be desirable to have the feet 52 tall enough to allow a user to slide their hand under the base 16 and push upwards on an insert that is located in the central opening 40 of the base 16, in order to remove the insert. In an exemplary embodiment, the feet 52 may be made of rubber, and inhibit the base from moving across a surface unintentionally during use. In other exemplary embodiments, the feet 52 may be made from a variety of other materials. In some exemplary embodiments, the feet 52 may be integral to the base with both the base and feet formed as a monolithic unit.

The base may be made of metal, such as aluminum. In other exemplary embodiments, the base may be made out of one or more materials including metal, wood, plastic, or a variety of other materials.

Figure 6:
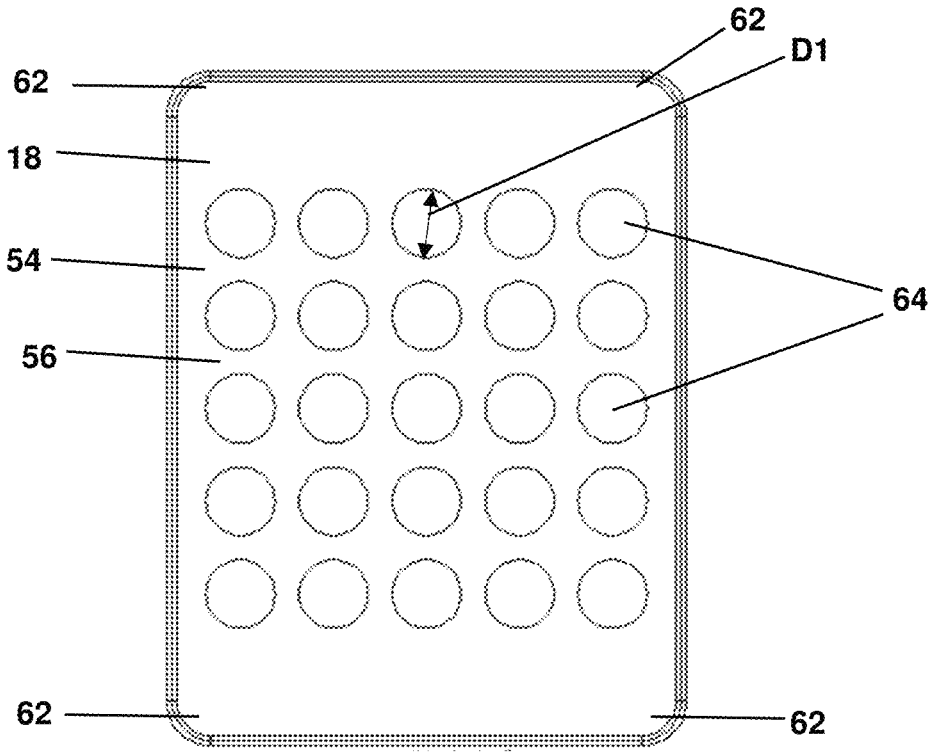
FIG. 6 is a top plan view of a first exemplary embodiment of an insert.
Figure 7:
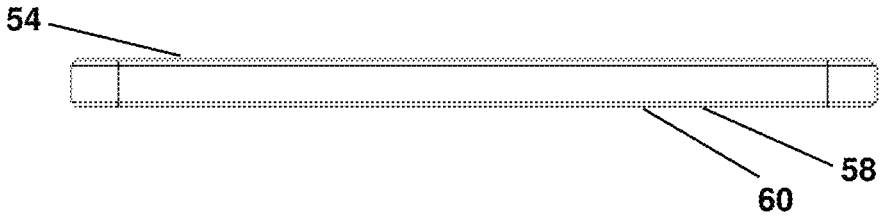
FIG. 7 is a side elevational view of the insert of FIG. 6.
Figure 8:
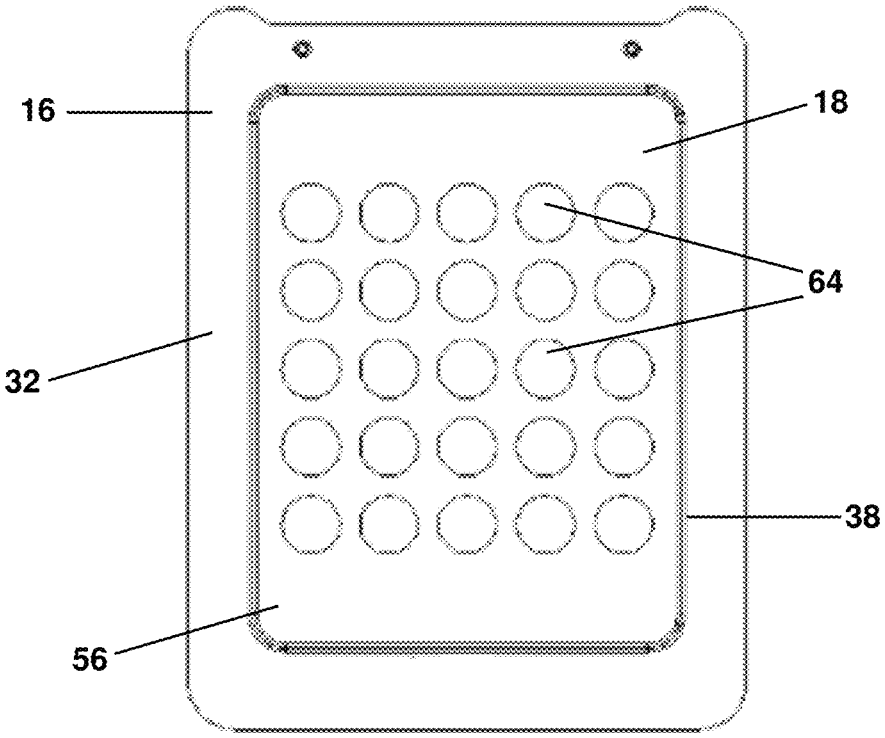
FIG. 8 is a top plan view of an assembly of the base of FIG. 2 and the insert of FIG. 6.

Referring to FIGS. 6 and 7, the exemplary embodiment of an insert 18, as shown in FIG. 1, is further depicted. The insert 18 is generally planar with a generally rectangular shape, having a front side 54 with a front surface 56 and a back side 58 with a back surface 60. The corners 62 of the insert 18 may be rounded. In an exemplary embodiment, and as shown in FIG. 8, the insert 18 may have a shape and dimensions that correspond to the shape and dimensions of the inner perimeter 38 of the front surface 32 of the base 16, such that the insert 18 may be placed on top of the recessed shelf 42. It may be desirable to have the insert 18 fit snugly within the inner perimeter 38 so that it does not shift during use, yet can still be removed when desired. It may also be desirable that the depth of the insert 18 and the depth of the recessed shelf 42 be such that when the insert 18 is located on top of the recessed shelf 42, the front surface 56 of the insert 18 is flush with the front surface 32 of the base 16.

Figure 9:
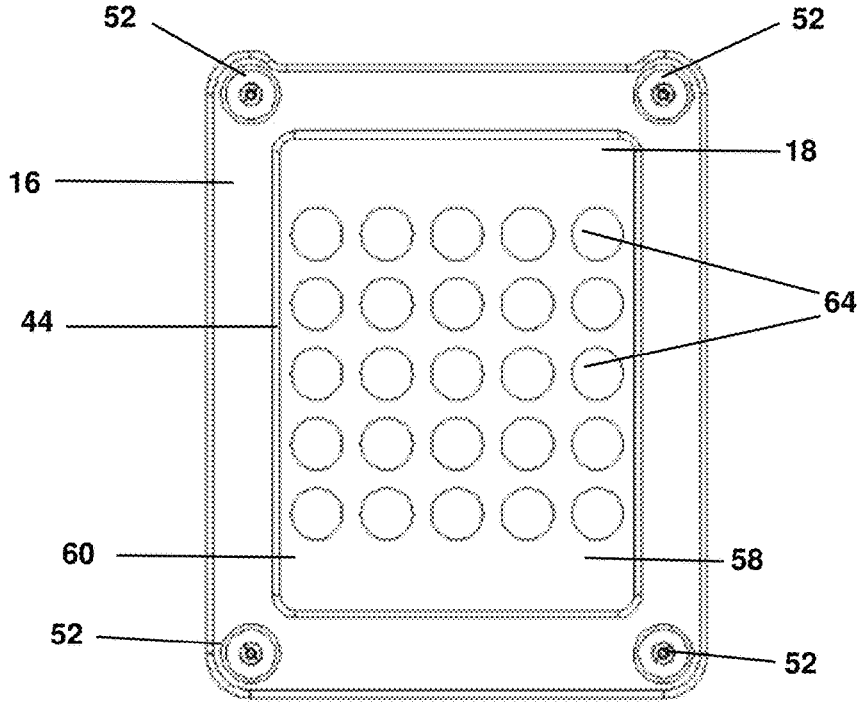
FIG. 9 is a bottom plan view of the assembly of FIG. 8.

The insert 18 has multiple openings 64 for receiving blisters. In this exemplary embodiment, the insert 18 has 25 circular openings 64 with a uniform diameter (D1) that are positioned and sized to hold up to 25 circular blisters. The openings 64 are positioned in an array pattern of uniform columns and rows. The insert 18 can hold a variety of blister pack array sizes up to a 5×5 array. The insert 18 may be used to hold circular blisters, or any other blister shape that fits within the circular openings. Referring to FIGS. 8 and 9, the insert 18 is shown set inside the base 16, forming the assembly 10. The base 16 rests upon the recessed shelf 42. A user can remove the insert 18 from the base 16 by pressing upwards on the back surface of the insert 18. The front side 54 and back side 58 of the insert 18 may be identical, such that it makes no difference which side is facing up or down when the insert 18 is located in the base 16. Having identical front and back sides may make it easier for a user to set up the assembly 10 because they do not have to ensure that a certain side is up or down.

The insert may be made of plastic, resin, metal, rubber, glass, or other materials. In exemplary embodiments, the insert may be made from high density polyethylene (HDPE) or ultra-high molecular weight polyethylene (UHMW). In other exemplary embodiments, the insert may be made from an acetal homopolymer such as DERLIN (DuPont, Wilmington Delaware), or an acetal copolymer. It may be desirable to choose a material that will not scratch the base and will also inhibit labels from sticking to it. It may be desirable that the inserts be made from a material that can be autoclaved or sterilized through other means. In an exemplary embodiment, the insert may be made of polypropylene (PP) or polypropylene copolymer (PPCO) so that it can be autoclaved.

Figure 10:
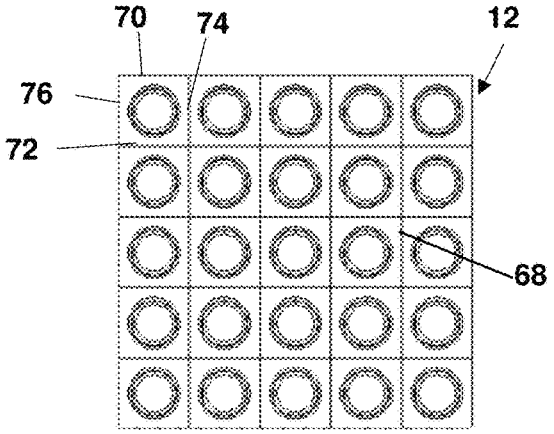
FIG. 10 is a top plan view of an exemplary embodiment of a blister pack.
Figure 11:
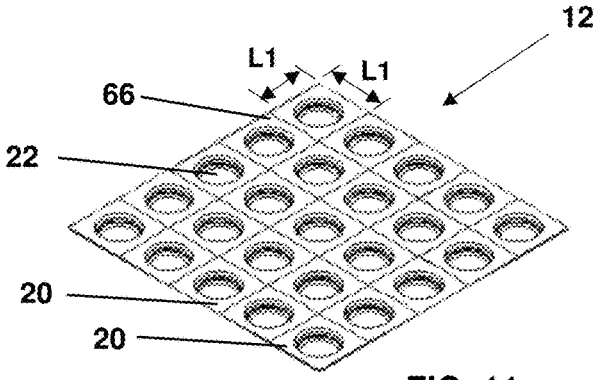
FIG. 11 is a side perspective view of the blister pack of FIG. 10.
Figure 12:
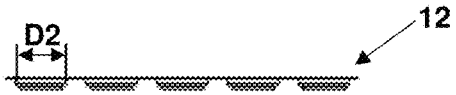
FIG. 12 is a side elevational view of the blister pack of FIG. 10.

Referring to FIGS. 10-12, the exemplary embodiment of a blister pack array 12 with round cavities 22 that may be used with the assembly 10 is shown. The blister pack array 12 may be a thermoformed plastic such as polyvinyl chloride (PVC), polyethylene terephthalate (PET), polyethylene terephthalate glycol (PETG), recycled polyethylene terephthalate (RPET), polychlorotrifluoroethylene (PCTFE) (such as ACLAR®, polyvinylidene chloride (PVDC) or high impact polystyrene (HIPS). The blister pack may be made out of any other pre-formed, molded, or constructed material as desired. In exemplary embodiments, the plastic may be fully transparent or transparent enough to allow any contents to be viewed through the plastic, or in other embodiments, the plastic may be opaque. In other exemplary embodiments, other materials may be used to form a blister pack array. The exemplary blister pack array 12 of FIGS. 10-12 is a 5×5 array, but various array sizes may be commercially available. The blister pack array 12 is comprised of multiple connected blisters 20 each having a round cavity 24 surrounded by a shelf 66. The blisters 20 are uniform in shape and size, with each cavity 22 having the same diameter (D2) at its widest point. Each blister 20 has a square, perforated perimeter 68 defining a top side 70, a bottom side 72, a right side 74, and a left side 76 of the blister 20, each having the same length L1. Accordingly, the blister pack array 12 presents the same regardless of how it is oriented relative to the insert 18. The perforated perimeters 68 allow a user to tear one or more blisters 20 away from adjoining blisters 20 through manual manipulation.

In an exemplary embodiment, a blister pack array shaped like that of FIGS. 10-12 may have the measurements of 6 inches×6 inches.

Figure 13:
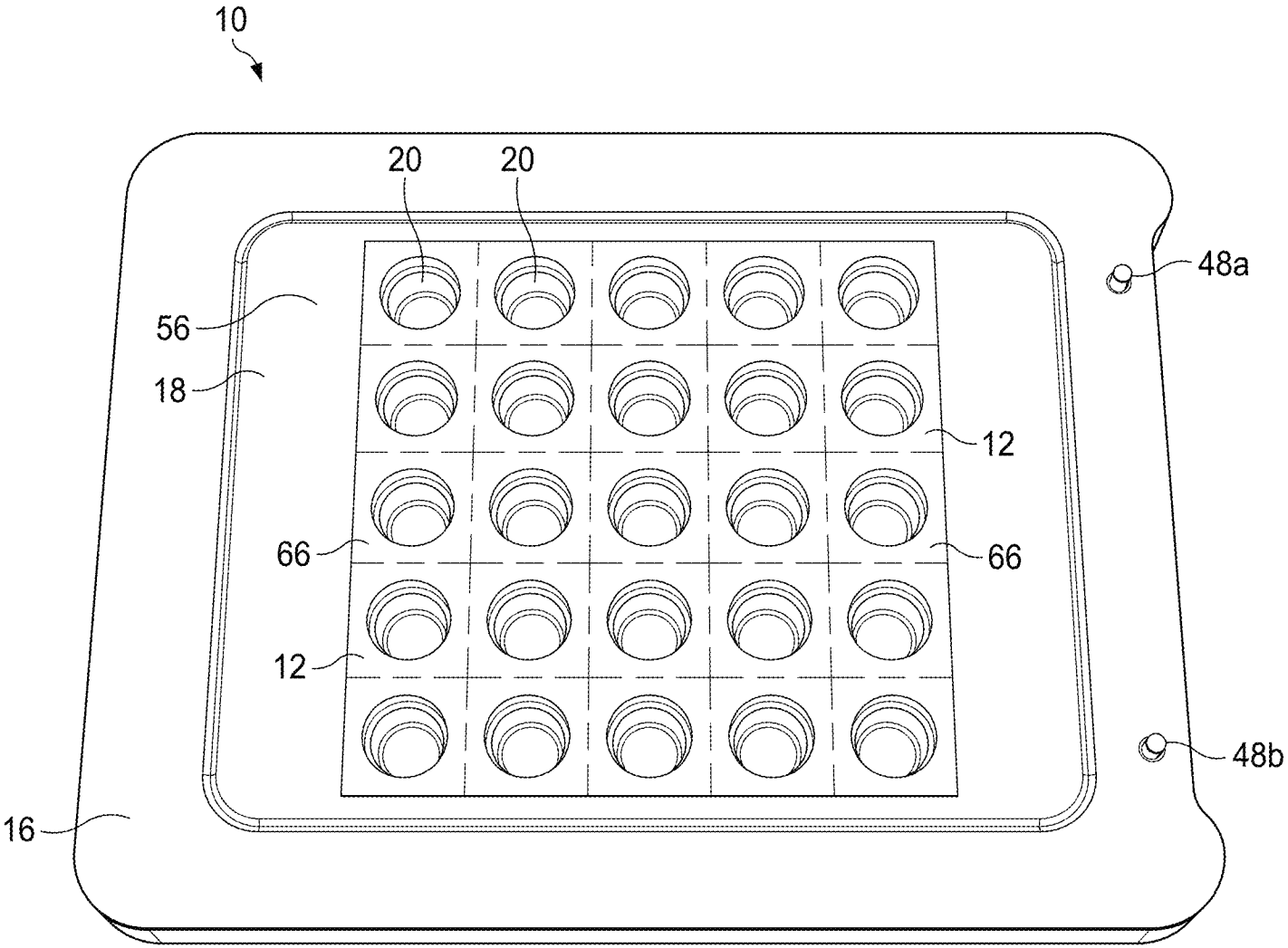
FIG. 13 is a side perspective view of the assembly of FIG. 8 with a blister pack inserted.

Referring to FIG. 13, the position and size of the blister cavities 22 may correspond to the position and size of the openings 64 on the insert 18, with the diameter D2 of the cavities 22 being less than the diameter D1 of the openings 64, to allow the blister pack array 12 to be nested into the insert 18. When nested into the insert 18, the shelves 66 of the blisters may be in direct contact with the front surface 56 of the insert 18. Any side of the blister pack array 12 may be oriented towards the top side 28 or bottom side 30 of the base 16, making it easier for a user to insert the array 12 into the assembly 10.

Figure 14:
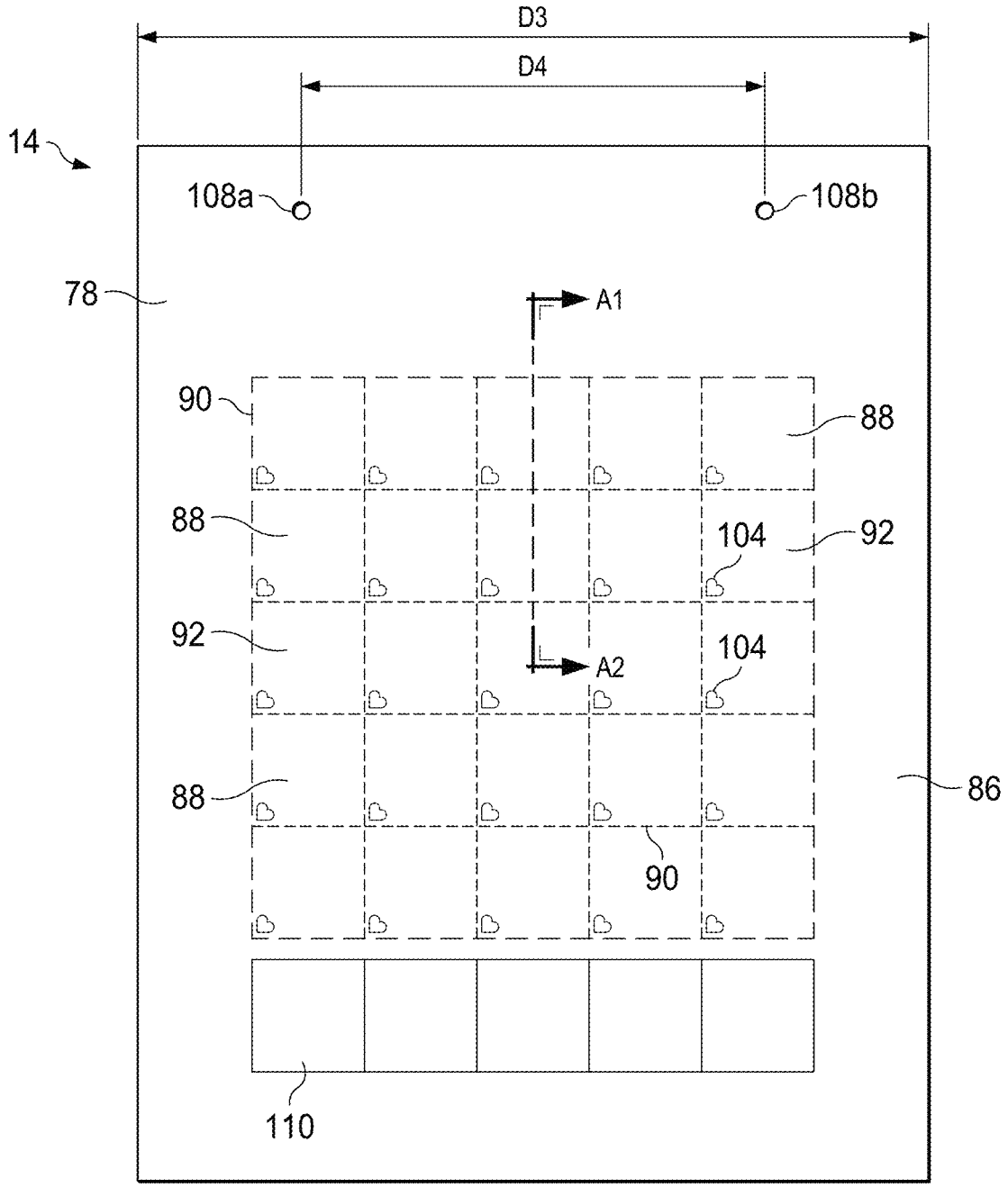
FIG. 14 is a top plan view of an exemplary embodiment of a label sheet.
Figure 15:
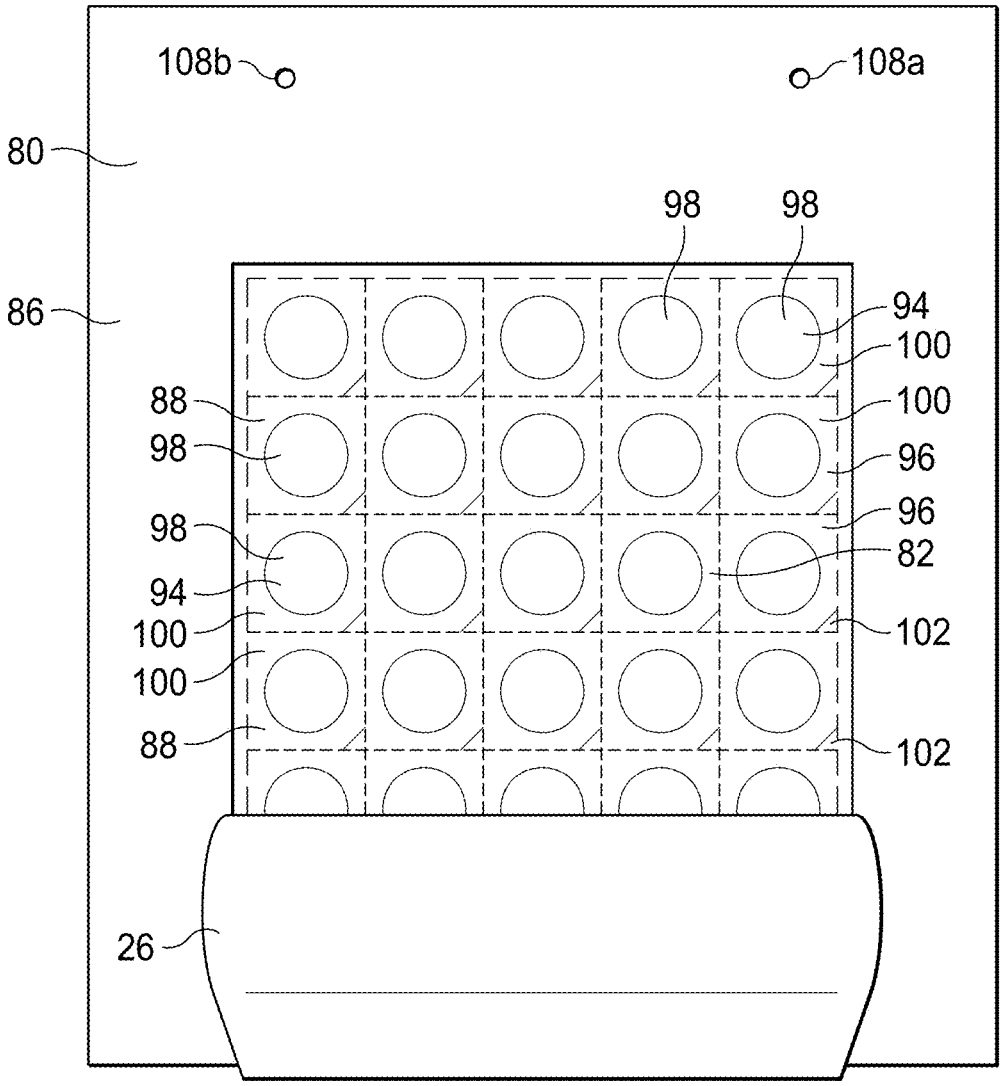
FIG. 15 is a bottom plan view of the label sheet of FIG. 14, with the back cover partially removed.

Referring to FIGS. 14 and 15, an exemplary embodiment of a label sheet 14 is shown. The label sheet 14 has a front side 78 and a back side 80 and is generally sectioned into a blister portion 82 having a perimeter 84, and a frame portion 86 that surrounds the blister portion 82. The blister portion 82 is comprised of multiple labels 88 oriented in a 5×5 array. Each label 88 has a generally square perimeter 90 that defines each label's front surface 92 and back surface 94. The label sheet may be printed on with a laser printer or other device to place information on each label's front surface 92. Such information may include any variety of written or computer readable information (such as a barcode) in order to convey information about the contents of blisters to labeled, including, but not limited to, content name, expiration date, source, date packaged, etc. Barcodes may allow a user to access NDC databases, or enterprise databases to obtain information about contents, and may also allow a user to record information pertaining to the opening of the packaged blister and use/ingestion of contents. Printing of label sheets may be done with the assistance of software that can provide printing templates for different label sheets.

The back surface 94 of each label 88 is comprised of an adhesive portion 96 and a central bare portion 98. The adhesive portion 96 may fully surround the central bare portion 98. An adhesive film 100 located on the adhesive portion 96 of the back surface 94 of a label 88 may provide a means for securing the label 88 to a corresponding blister. The adhesive film 100 may be a pressure-sensitive adhesive capable of forming a strong enough bond with the blister material that it cannot be removed without creating a noticeable rip in the label. In the exemplary embodiment of FIGS. 14-15, the adhesive portion 96 is located to correspond with the shelf 66 of the corresponding blister 20 of the blister array 12 shown in FIGS. 10-12. The central bare portion 98 has no adhesive film. The location and size of the central bare portion 98 matches the location and size of the cavity 22 on the corresponding blister 20. The adhesive portion 96 of each back surface 94 may be uniform, collectively creating a uniform pattern of adhesive portions 96 across the different back surfaces 94 of the labels 88. When the label sheet 12 is applied to the blister array 12, the central bare portion 98 of each label 88 prevents any contents of the resulting blister pack from sticking to the back surface 94 of the label 88 or otherwise being coated with adhesive film 100.

The back surface 94 of each label 88 may also comprise a bare corner portion 102 that lacks adhesive film. Due to the absence of adhesive, the bare corner portion 102 of a label 88 may provide a flap on a resulting labeled blister that can be used as a pull point. That is, a point on the applied label that can be pinched, grasped, or otherwise manipulated by a user in order to partially or fully peel the label away from the blister as desired to access any contents of the blister.

Each label 88 on the label sheet 14 may have a bare corner portion 102 in the same location (i.e., lower left corner). Furthermore, the location of the bare corner portion 102 may be identified on the front surface 92 with a visual indicator 104. In an exemplary embodiment, the visual indicator 104 is a heart icon located in the lower left corner of the front surface 92. One of ordinary skill in the art will recognize that a variety of visual indicators could be used to identify which corner (or corners) of the label comprise a bare corner portion that may be manipulated in order to initiate the peeling of the label away from the blister. Furthermore, in an exemplary embodiment the type of indicator and the color of the indicator may also be utilized to convey information about the blister packaging or the contents of the blister. For example, an indicator may convey the classification of the blister (e.g., class A, class B, class C) which may be dictated by the ability of blister packaging to keep moisture out. Or, the color may identify information about the contents of the blister. For example, one color may identify that the blister contains pain killers, and another color may indicate that the blister contains antacids. Different indicators may identify different drug classes. In some exemplary embodiments, more than one visual indicator may be used to convey multiple pieces of information about the blister packaging or contents of the blister. One of ordinary skill in the art will recognize that various combinations of indicators and/or colors may be used as desired to visually convey different types of information.

In an exemplary embodiment, different labels on a label sheet may have bare corner portions on different corners of each individual label, and may have bare corner portions on more than one corner. In yet another exemplary embodiment, there may be no bare corner portions on all or some of the labels.

In an exemplary embodiment, classification of blister packaging may be based on testing of sample packaging to determine the amount of moisture permeation into the blister over a predetermined amount of time. In an exemplary embodiment, blisters may be categorized as belonging to Class A, Class B, or Class C, and identified as such through an indicator or other means. In this exemplary embodiment, 10 samples of different types of packaged blisters are tested. Class "A" blisters are those of a type that during testing no more than 1 of 10 samples exceeded 0.5 mg per day of moisture permeation, and none of the samples exceeded 1 mg per day of moisture permeation. Class "B" blisters are those of a type that during testing no more than 1 in 10 samples exceeded 5 mg per day of moisture permeation, and none exceeded 10 mg per day. Class "C" blisters are those of a type that during testing no more than 1 in 10 samples exceeded 10 mg per day of moisture permeation, and none exceeded 20 mg per day. A moisture permeation formula ("MPF") used for testing may be as follows:

$$MPF=((1/N)[(W_f-W_i)-(C_f-C_i)]$$

Wherein:

N=number of days expired in the test period (beginning after the initial 24-hr equilibration period)

$W_f$=final weight of each test container (mg)

$W_i$=initial weight of each test container (mg)

$C_f$=average final weight of the controls (mg)

$C_i$=average initial weight of the controls (mg)

It will be appreciated by one of ordinary skill in the art that blister packaging may be categorized according to many different features and characteristics, moisture permeation may be calculated in various ways, and nothing herein is intended to limit the inventive concept to any particular embodiment.

The label sheet 14 may be provided with a removable backing 26. In a first position (not shown), the removable backing 26 having a perforated perimeter 106 lies flat across a portion of the back side 80 of the label sheet 14 that comprises the blister portion 82. In this first position, the removable backing 26 covers the back surfaces 94 of the labels 88 and may serve to not only keep the back surfaces 94 of the labels 88 clean, but to also preserve the efficacy of the adhesive film 100 which may be jeopardized if it comes into contact with dust, other surfaces or otherwise is exposed to the ambient environment for too long. The adhesive film 100 holds the removable backing 26 in place. In a second position, and with reference to FIG. 15, the removable backing 26 has been substantially peeled away from the back surfaces 94 of the labels 88. The removable backing 26 may be completely removed from the label sheet 14 to expose the entire back surface 94 of the labels.

Located at the top side of the label sheet 14 are two locator holes 108*a*, 108*b*, that are sized and positioned to receive locator pins from a corresponding base.

The front side 78 of the label sheet 14 may also include one or more appendix labels 110. Appendix labels 110 may be peeled off of the label sheet 14 and used as desired to label items and/or record information. In an exemplary embodiment, all or a portion of the back surface of the appendix labels contain adhesive film. In still other exemplary embodiments, appendix labels may exhibit the same adhesive portions and central bare portions on their back surface to enable them to serve as labels for blister packs. In some exemplary embodiments, there may be no appendix labels on the label sheets.

Figure 16:
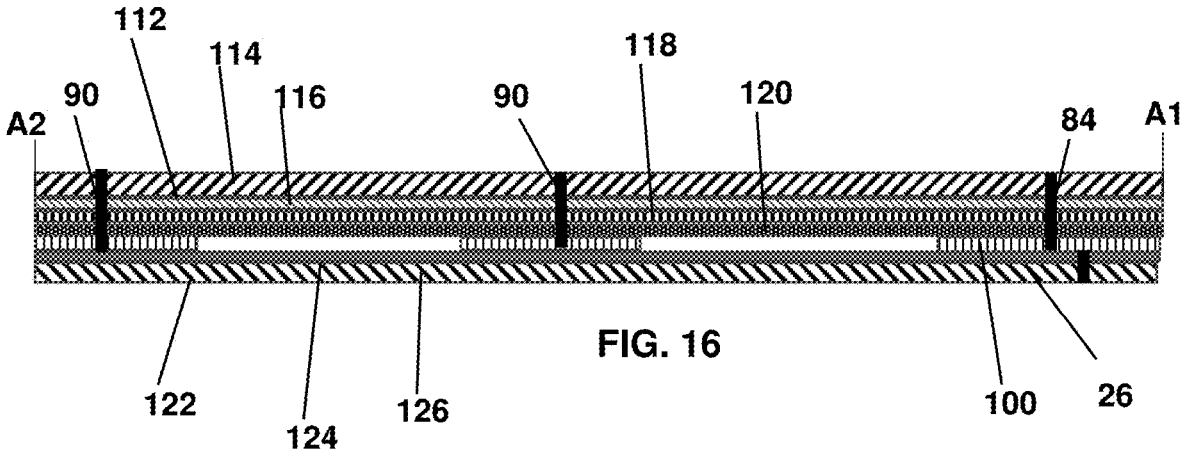
FIG. 16 is a cross-sectional view of the label sheet of FIG. 14, along line A-A.

Referring to FIG. 16, a cross-section of the label sheet 14 taken along line A1-A2 is shown. In this exemplary embodiment, the label sheet 14 is comprised of multiple sections that are comprised of one or more materials. A paper-foil face 112 may be comprised of layers of paper 114, low density polyethylene (LDPE) 116, aluminum foil 118, and a primer 120. A paper liner 122 that comprises the removable backing may be formed from layers of silicone 124 and paper 126. In between the paper-foil face 112 and paper liner 122 is adhesive film. The adhesive film 100 may be hot melt rubber-based adhesive.

In other exemplary embodiments, different materials may be used to create the different sections of the labels. In some embodiments, the face layer may be a combination of materials and/or layers that include paper and foil, or any other materials that alone or in combination permit the top surface of the labels to be printed on, provide a surface for adhesive firm, and provide a barrier to moisture. A variety of LDPE, plastic barriers, or foils may be used. Similarly, a variety of materials may be used for the paper liner, or in lieu of a paper liner, if they permit protection of the efficacy of the adhesive film prior to use. One of ordinary skill in the art will recognize that a variety of materials may be used for the label sheets without departing from the scope of the invention, and nothing herein is intended to limit the scope to the embodiment in FIG. 16.

As shown in FIG. 16, the removable backing 26 is a portion of the paper liner 122 that may be separated from the remainder of the label sheet 12. The removable backing 26 may have a length and width that is greater than the length and width of the blister portion 82 and covers an outer portion 128 that surrounds the blister portion perimeter 84. The larger outer perimeter 106 of the removable backing 26, as compared to the perimeter 84 of blister portion 82, may improve the structural integrity of the label sheet 14 before use, and help prevent the blister portion 82 from being partially or wholly separated from the rest of the label sheet 14 prior to use.

The label sheet may be provided as a singular item to a user, or as one of many label sheets that together form a pad of label sheets. Individual label sheets may be torn from the pad when needed.

Figure 17:
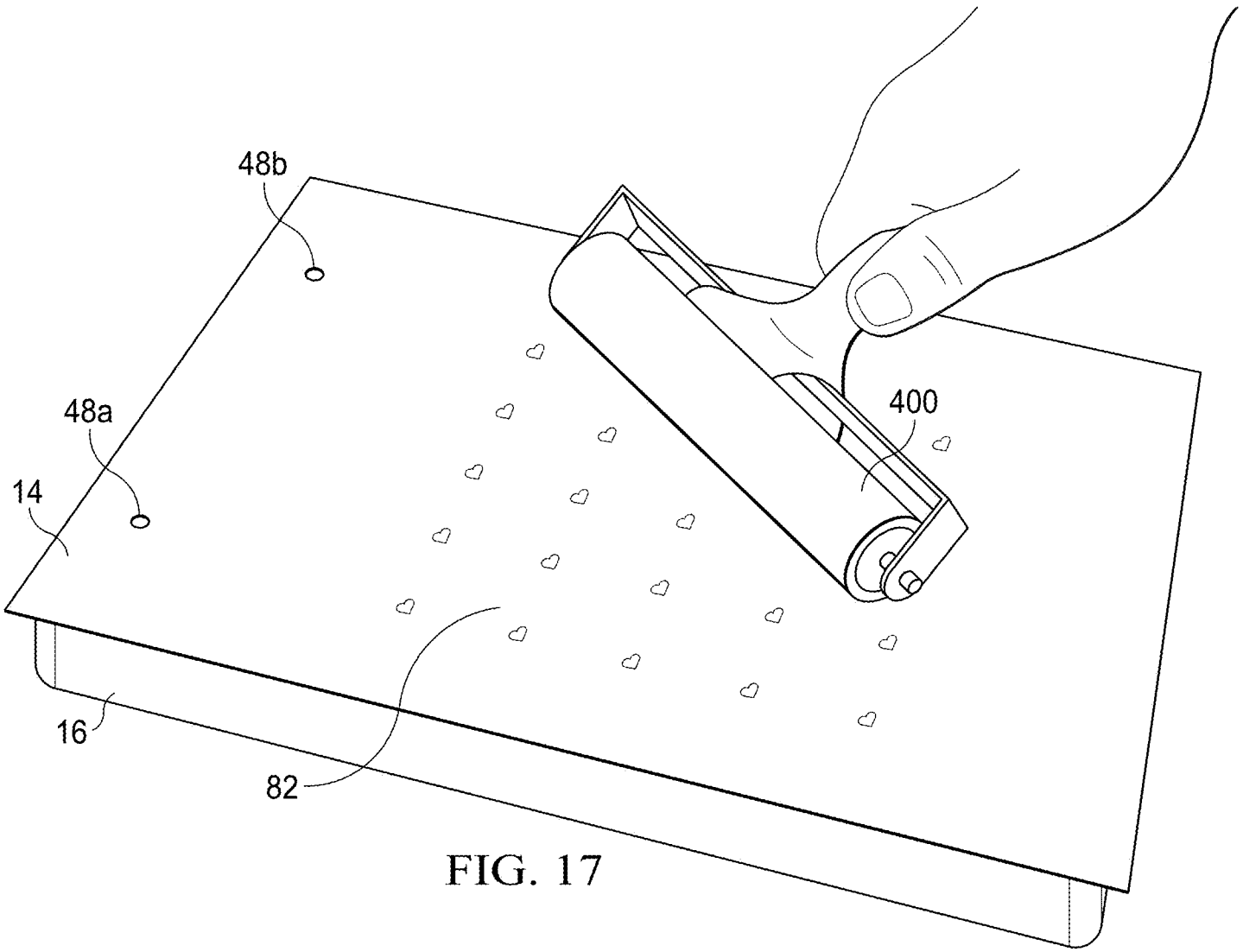
FIG. 17 is a side perspective view demonstrating how a label sheet anchored to the assembly may be applied to a blister pack.

An exemplary embodiment of a method for creating sealed blisters is demonstrated. In an initial step, a user selects the insert 18 and places it into the base 16 to form an assembly 10. A user may obtain a blister pack array 12 and place it into the assembly 10, where the selected insert 18 corresponds to the blister pack array 12, as shown in FIG. 13. Any items to be packaged within the resulting blister packs may be placed into the individual blisters 20 as desired. This may be done before or after nesting the blister pack array 12 into the insert 18. The user may then obtain a corresponding label sheet 14 with the removable backing 26 removed, exposing the back surfaces 94 of each of the labels 88 on the sheet 14. The user may then place the label sheet on top of the blister pack array 300 and assembly 10 by lining up the locator holes 108*a*, 108*b* on the label sheet 12 with the locator pins 48*a*, 48*b* on the base, inserting the pins through the holes, and guiding the labels sheet down until it rests on top of the assembly 10 and blister pack array 12. The use of the locator pins and locator holes helps ensure that the perimeters of the labels and blisters are in properly alignment. The user may then apply pressure to the top of the label sheet 14 in order to secure the adhesive film portions on each of the labels 88 with the shelves 66 of each corresponding blister 20 of the blister pack array 12. Referring to FIG. 17, pressure may be applied to the top of the label sheet 14 through the use of a rubber hand roller 400 that is manually rolled across the top of the blister portion 82. In other exemplary embodiments, other tools may be used as desired to apply pressure to the top of the label sheet and cause a secure bond between the labels and blisters. In yet other exemplary embodiments, a user may solely use their hands to apply pressure across the top of the blister portion.

Figure 18:
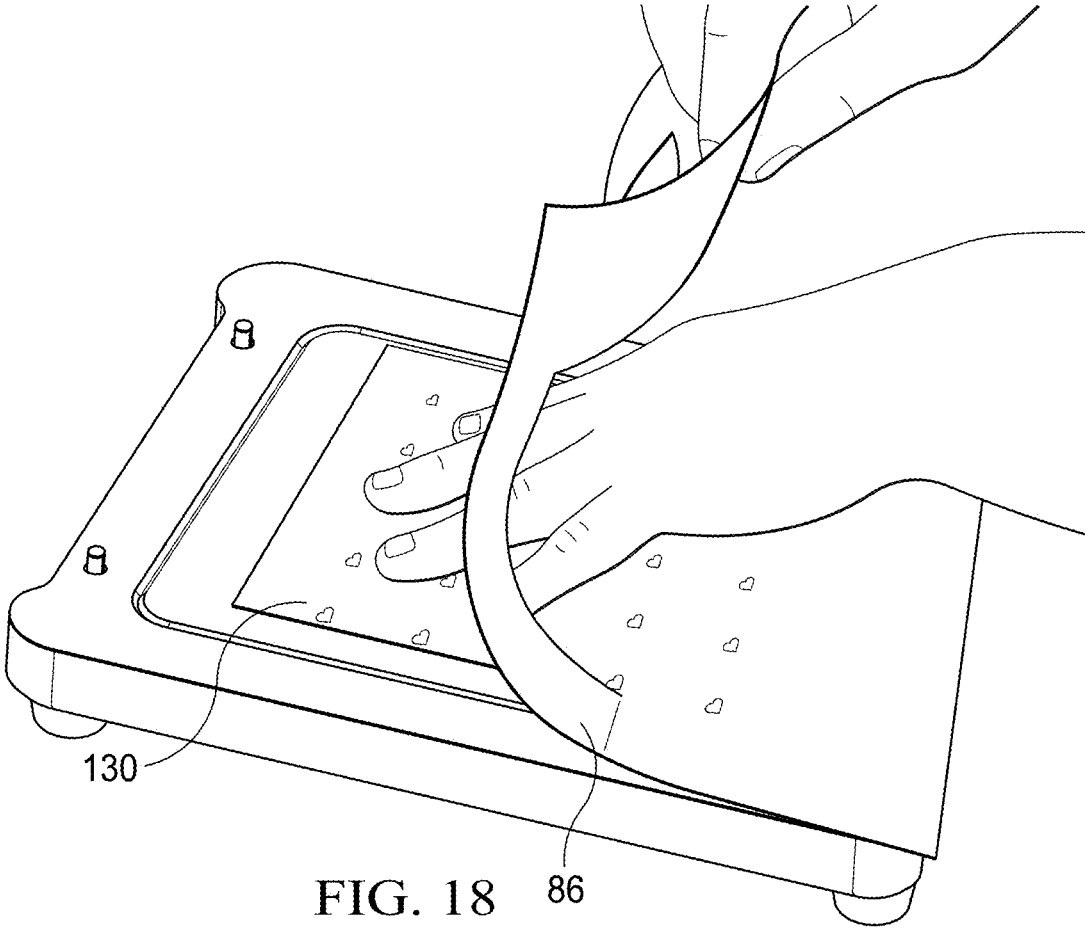
FIG. 18 is a side perspective view demonstrating the removal of an outer frame portion from a sealed blister pack.

Once the labels and blisters have been bonded together, creating a sealed blister array 130, the sealed blister array 130 may be separated from the outer frame portion 86 of the label sheet 14. As shown in FIG. 18, a user may separate the outer frame portion 86 by holding the sealed blister array 130 in place in the assembly, and lifting up on the outer frame portion. The outer frame portion 86 may separate along the perforated perimeter 84 of the blister portion 82. In this manner, the user may completely remove the outer frame portion 86, which may subsequently be discarded, if desired. In other exemplary embodiments, the outer frame portion 86 may be separated from the sealed blister array 130 in a variety of ways. The insert 18 may be removed from the base 16 in a variety of ways, including, but not limited to, by pushing up on the bottom surface of the insert 18, grabbing the insert from the top and pulling it up, or by turning over the base 16. A user may then select a different insert corresponding to a different blister pack that needs to be labeled, and repeat the process using different label sheets that correspond to the different blister packs.

Figure 19:
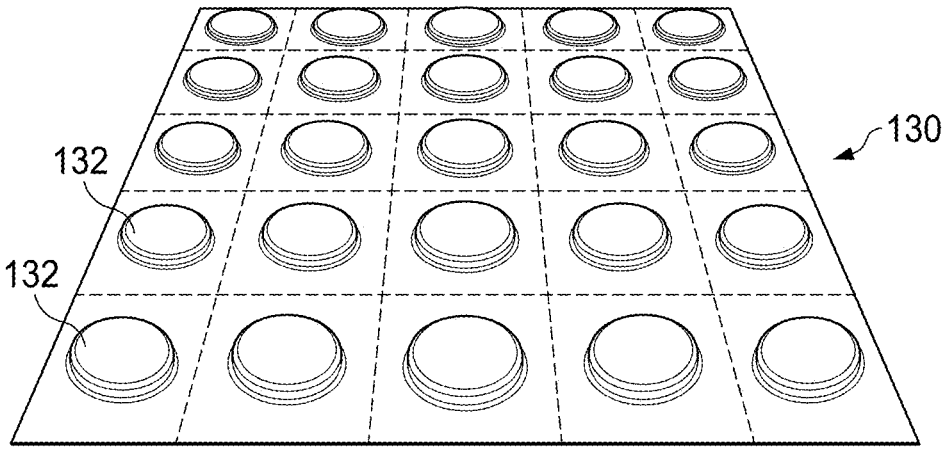
FIG. 19 is a front perspective view of a sealed blister pack.
Figure 20:
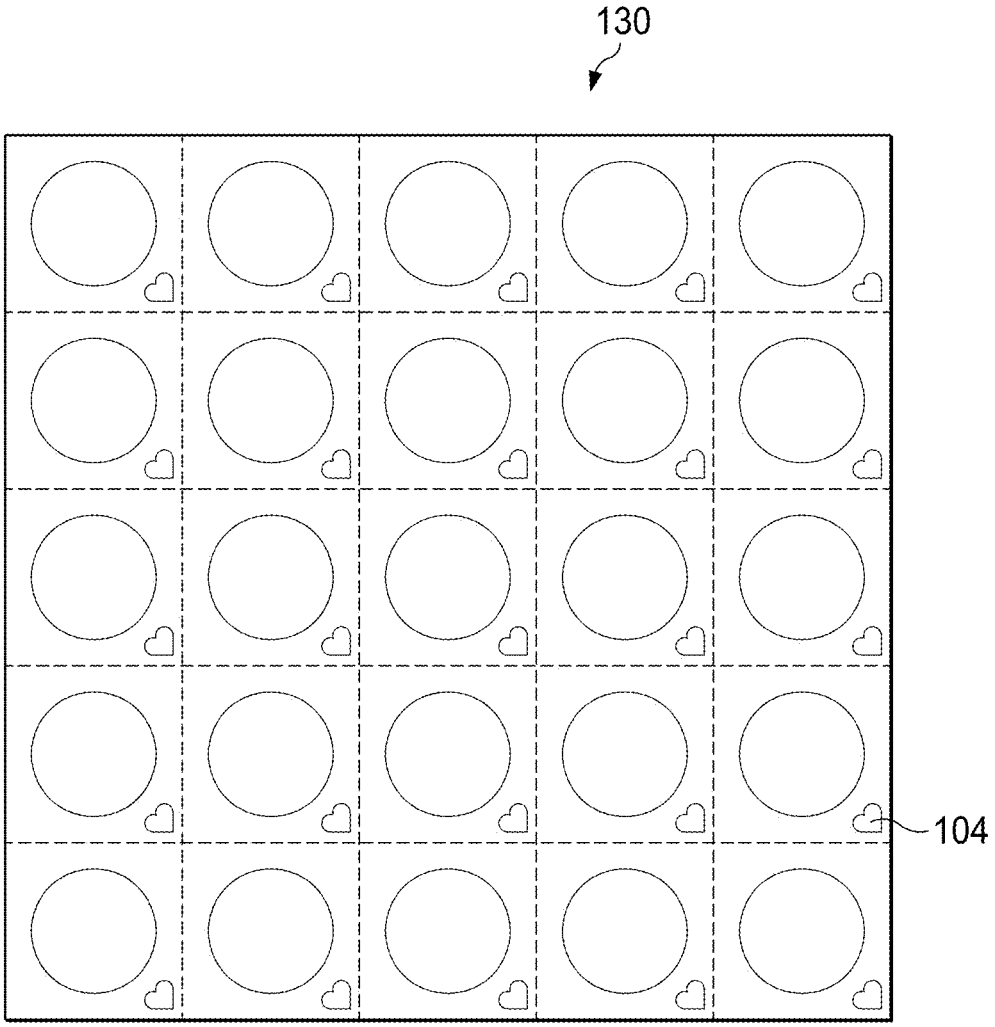
FIG. 20 is a back perspective view of the sealed blister pack of FIG. 19.

An exemplary embodiment of a sealed blister array 130 manufactured according to the exemplary method is shown in FIGS. 19 and 20. One or more individual sealed blisters 132 may be separated by a user by tearing along the perforated perimeters of each sealed blister 132. A user may also separate the individual blisters 132 by cutting along the perimeters.

It will be recognized by one of ordinary skill in the art that the inventive concepts herein may be utilized with a variety of blister packs having different blister shapes, and corresponding inserts that may be interchangeably used with the same base.

Figure 21:
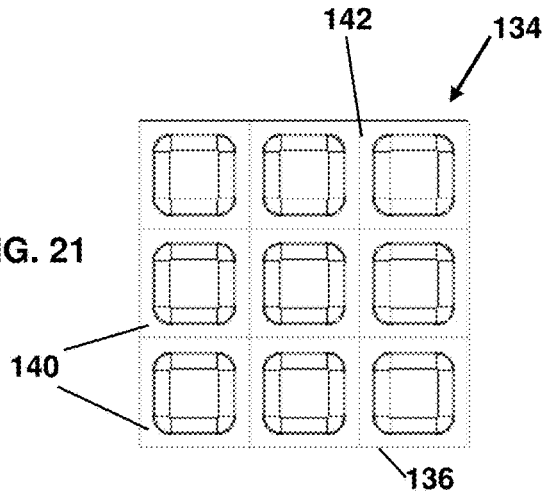
FIG. 21 is a top plan view of an exemplary embodiment of a blister pack.
Figure 22:
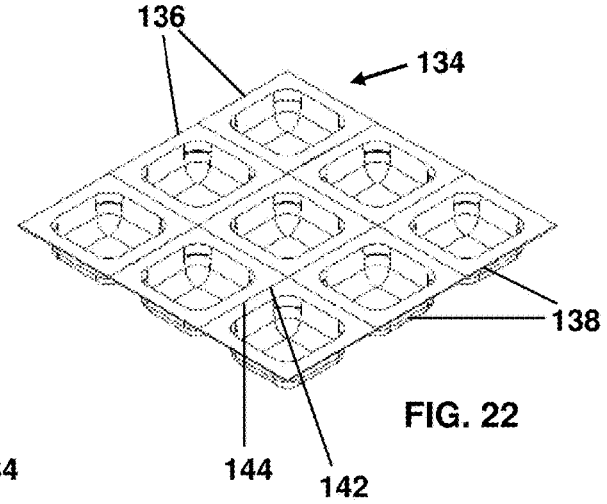
FIG. 22 is a side perspective view of the blister pack of FIG. 21.
Figure 23:
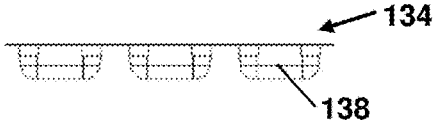
FIG. 23 is a side elevational view of the blister pack of FIG. 21.

Referring to FIGS. 21-23, an exemplary embodiment of a 3×3 blister pack array 134 having blisters 136 with generally square cavities 138 is shown. Depending on the anticipated contents, the blister pack array 134 with generally square cavities 138 may be preferrable to use over a blister pack array having round cavities, such as the array shown in FIGS. 10-12. Similarly, the cavity 138 of each of the blisters 136 is surrounded by a shelf 140. Each blister is defined by a perimeter 142. Perforations 144 along common perimeters 142 of adjoining blisters 136 allow a user to tear or easily cut one or more of the blisters 136 from the adjoining blisters.

Figure 24:
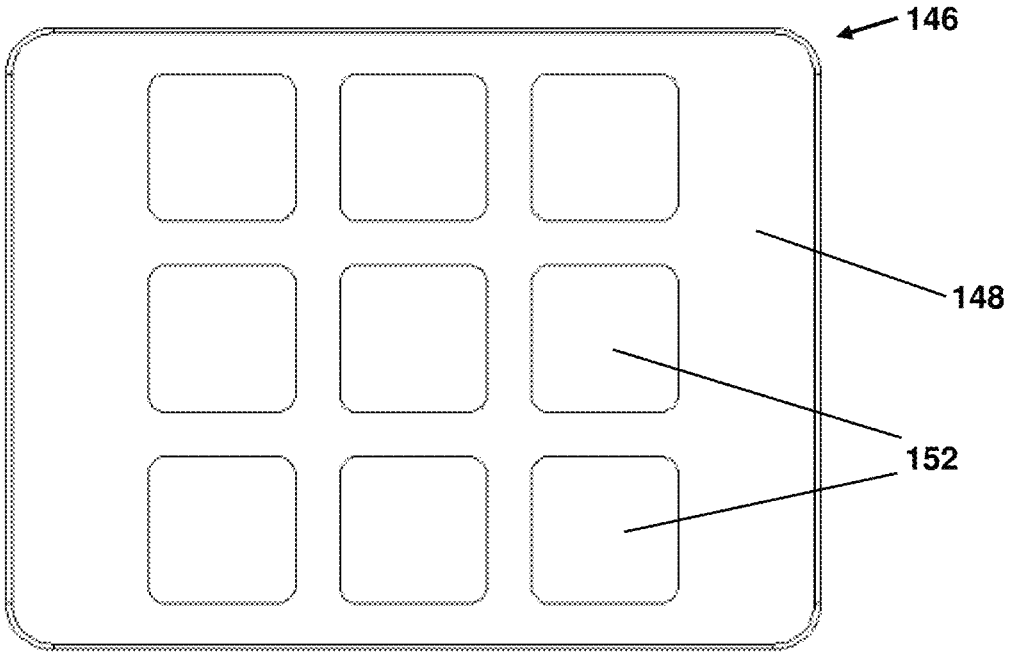
FIG. 24 is a top plan view of an exemplary embodiment of an insert.
Figure 25:
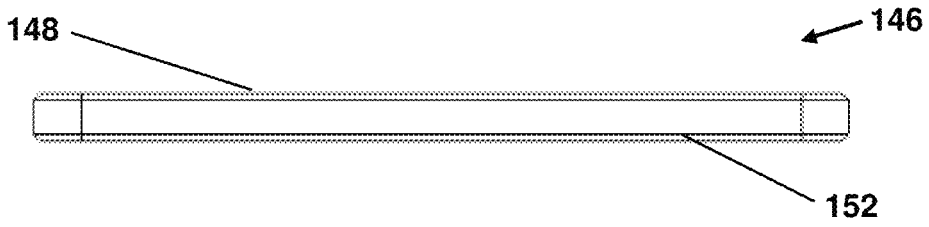
FIG. 25 is a left side elevational view of the insert of FIG. 24.
Figure 26:
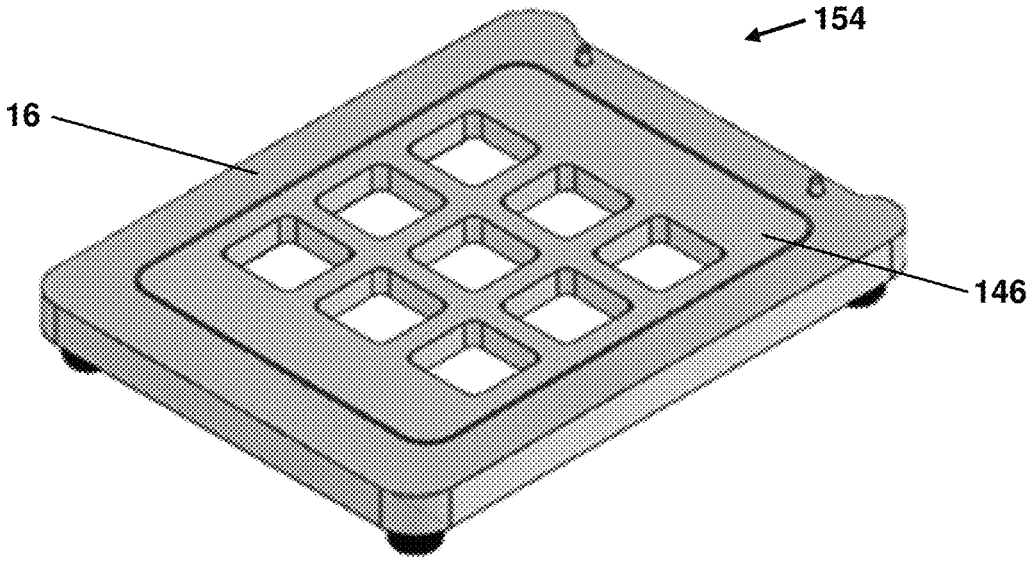
FIG. 26 is a side perspective view of an assembly of a base with the insert of FIG. 24.

Referring to FIGS. 24-25, an exemplary embodiment of an insert 146 for use with the blister pack array of FIGS. 21-23 is shown. The insert 146 has a front surface 148 and a back surface 152. Nine openings 152 in the insert 146 correspond in shape, size, and orientation to the blister cavities of the blister pack array 134, such that the blister pack array 134 may be nested into the insert 146. The array 134 may be inserted in any orientation. The overall shape and dimensions of the insert 146 may correspond to the inner perimeter 38 of the front surface 32 of the base 16, such that the insert 146 may be placed on top of the recessed shelf 42. Referring to FIG. 26, an assembly 154 comprising the base 16 and the insert 146 is shown. It will be appreciated that the insert 146 can be interchangeable with other inserts in order to use the same base to package blisters of varying shapes and sizes.

Figure 27:
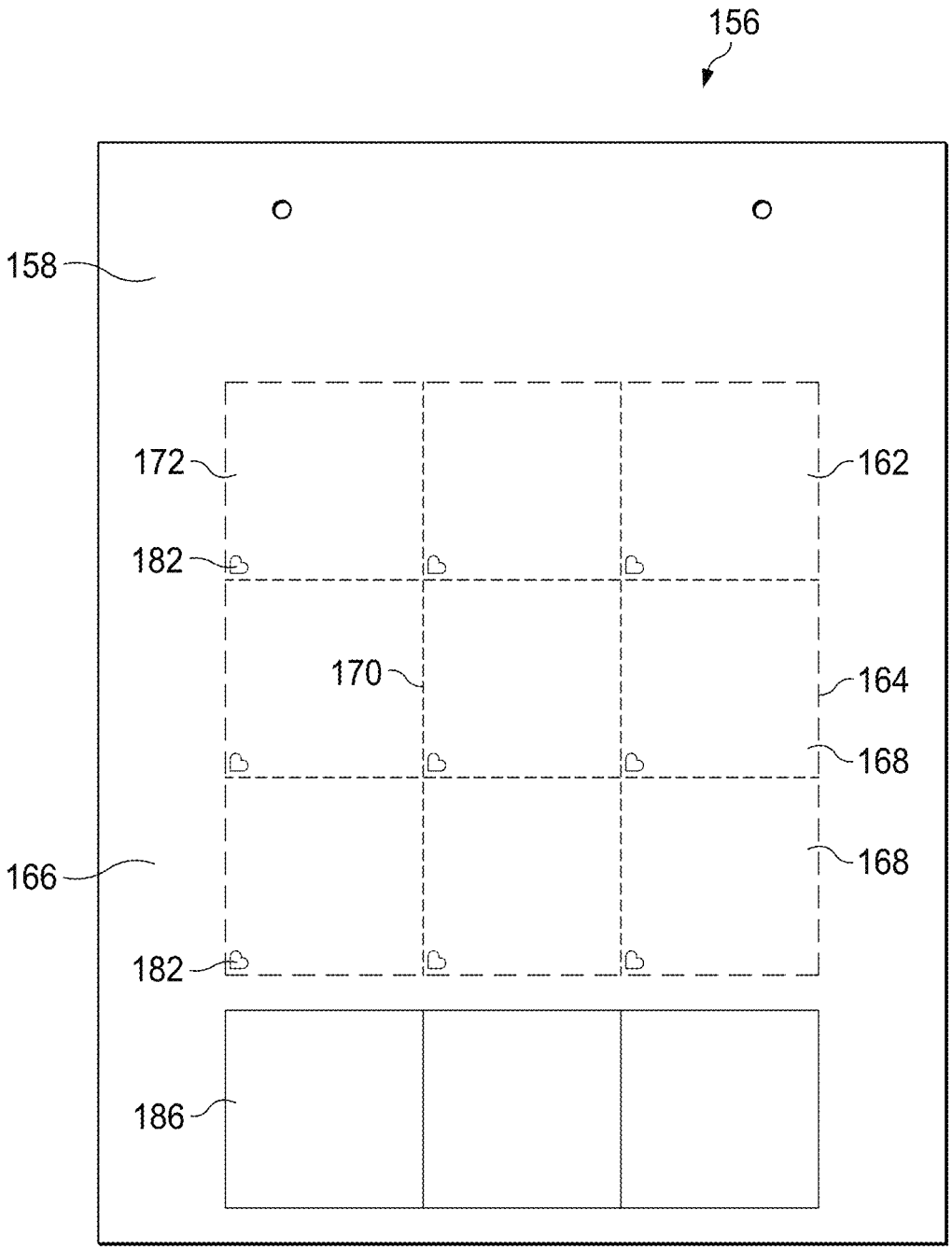
FIG. 27 is a top plan view of an exemplary embodiment of a label sheet.
Figure 28:
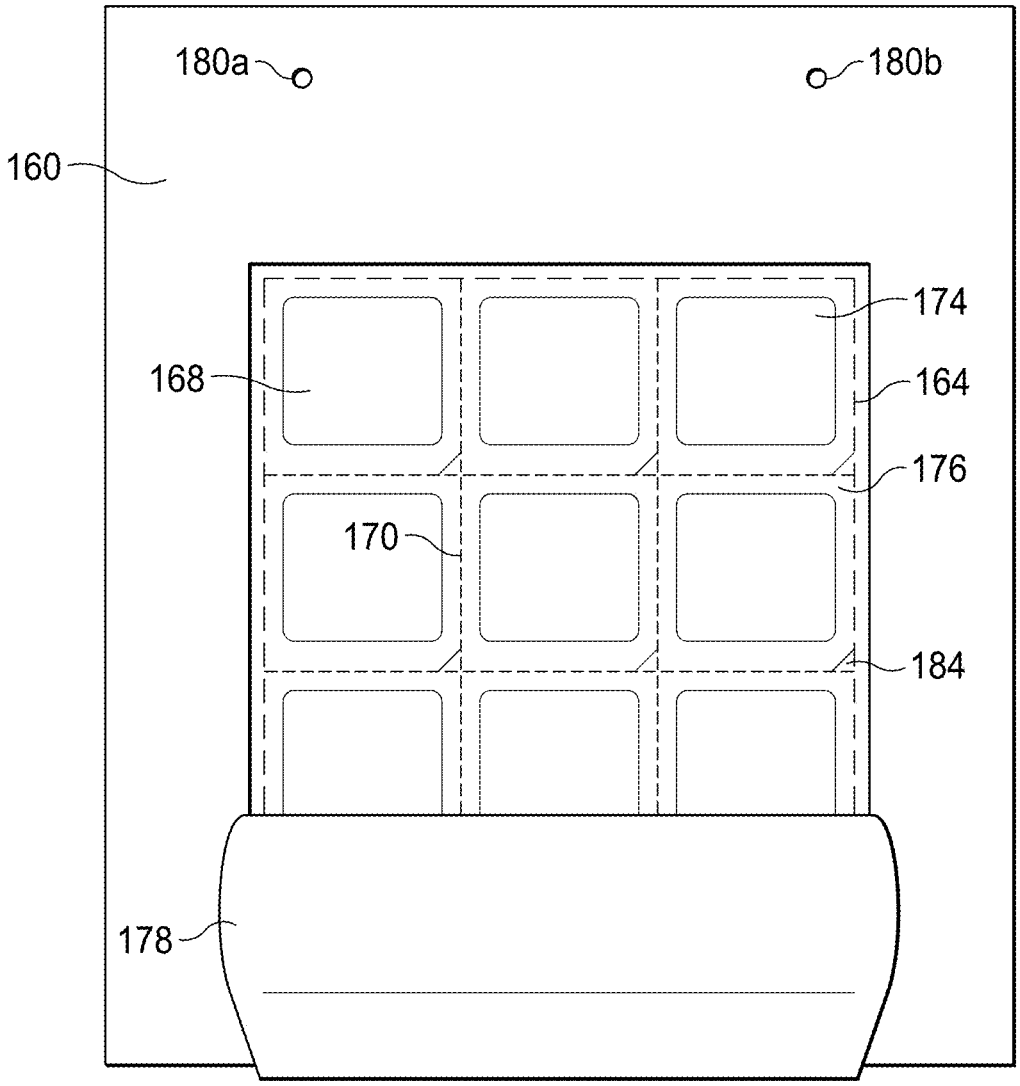
FIG. 28 is a bottom plan view of the label sheet of FIG. 27, with the back cover partially removed.

Referring to FIGS. 27 and 28, an exemplary embodiment of a label sheet 156 for a 3×3 blister pack array having generally square blisters is shown. The label sheet 156 has a front side 158 and a back side 160 and is generally sectioned into a blister portion 162 having an outer perimeter 164 and a frame portion 166 that surrounds the blister portion 162. The blister portion 162 is comprised of multiple labels 168 oriented in a 3×3 array. Each label 168 has a generally square perimeter 170 that defines the label's front surface 172 and back surface 174. The back surface 174 of each label comprises an adhesive portion 176 that is sized and oriented to correspond with the shelf 140 of the blister pack array 134.

The label sheet 156 also comprises a removable back cover 178. Locator holes 180*a*, 180*b* located on the label sheet 156 correspond with the size and location of the locator pins 48*a*, 48*b* on the base 16. On the front surface 172 of each label 168 is a visual icon 182 that corresponds with a bare corner portion 184 on the back surface 174. Appendix labels 186 are located below the blister portion 162.

The label sheet 156 may be used as part of the same method described herein to apply the labels 168 to the blisters 136 and create sealed blister packs.

Figure 29:
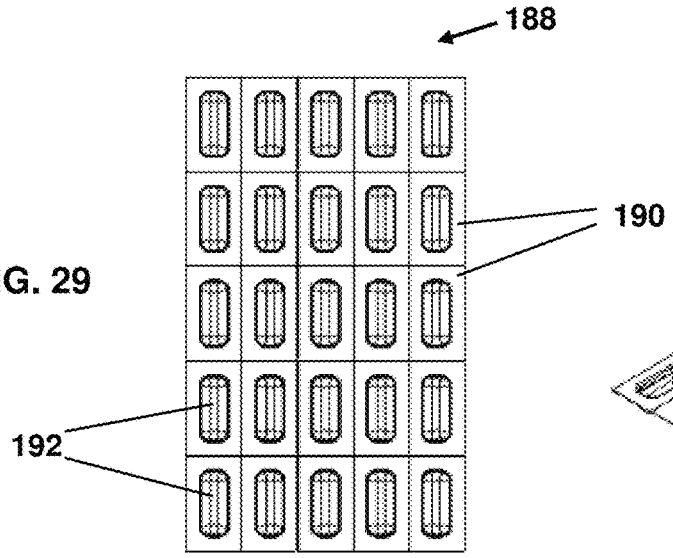
FIG. 29 is a front plan view of an exemplary embodiment of a blister pack with oblong blister cavities.
Figure 30:
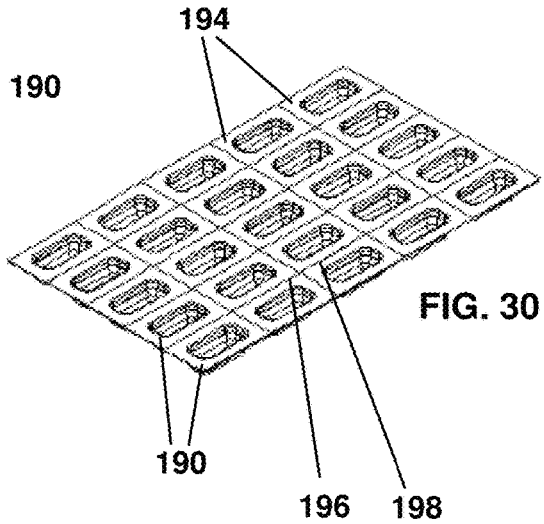
FIG. 30 is a side perspective view of the blister pack of FIG. 29.
Figure 31:
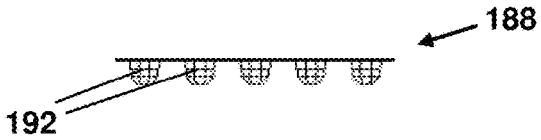
FIG. 31 is a top elevational view of the blister pack of FIG. 29.

Referring to FIGS. 29-31, an exemplary embodiment of a 5×5 blister pack array 188 having blisters 190 with generally oblong shaped cavities 192 is shown. This blister pack array 188 may be desired for holding a variety of pills and capsules that are oblong. The cavity 192 of each of the blisters 190 is surrounded by a shelf 194, and each blister 190 is defined by a rectangular perimeter 196. Perforations 198 along common perimeters 196 of adjoining blisters 190 allow a user to tear or easily cut one or more of the blisters 190 from the adjoining blisters.

Figure 32:
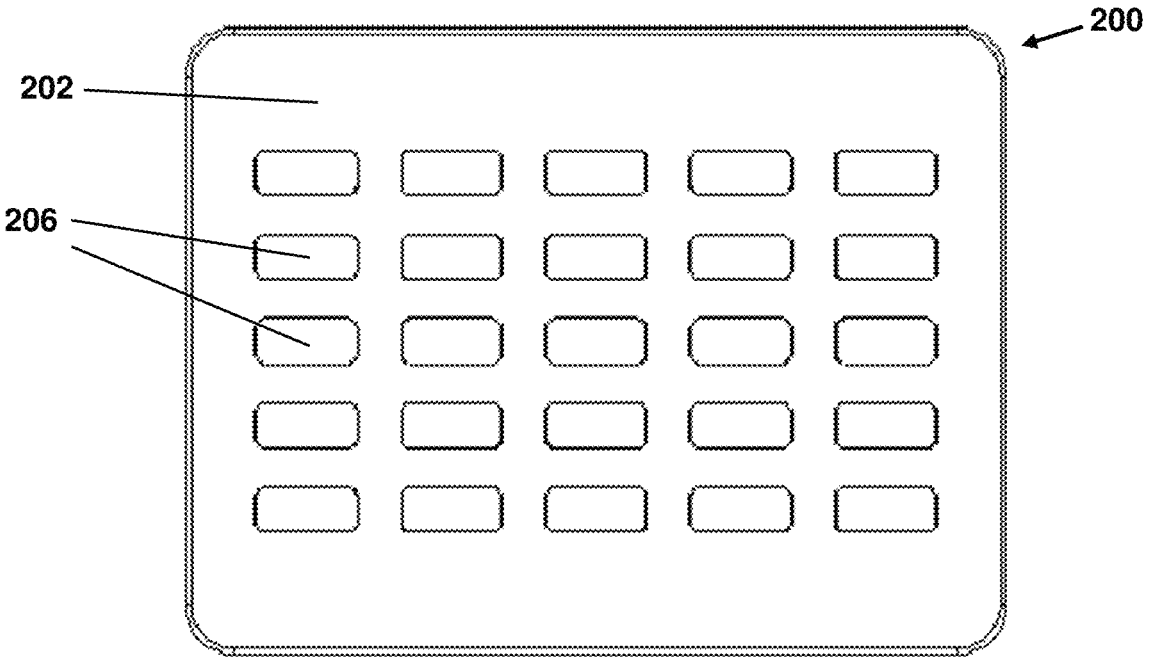
FIG. 32 is a top plan view of an exemplary embodiment of an insert.
Figure 33:
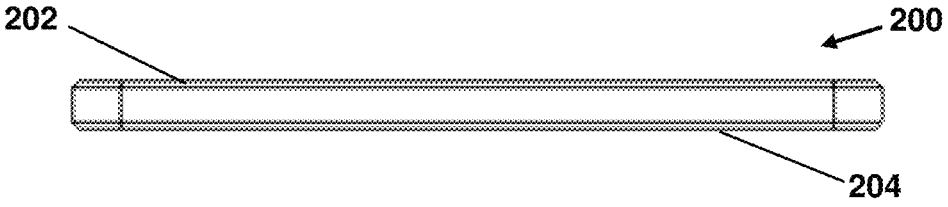
FIG. 33 is a left side elevational view of the insert of FIG. 32.
Figure 34:
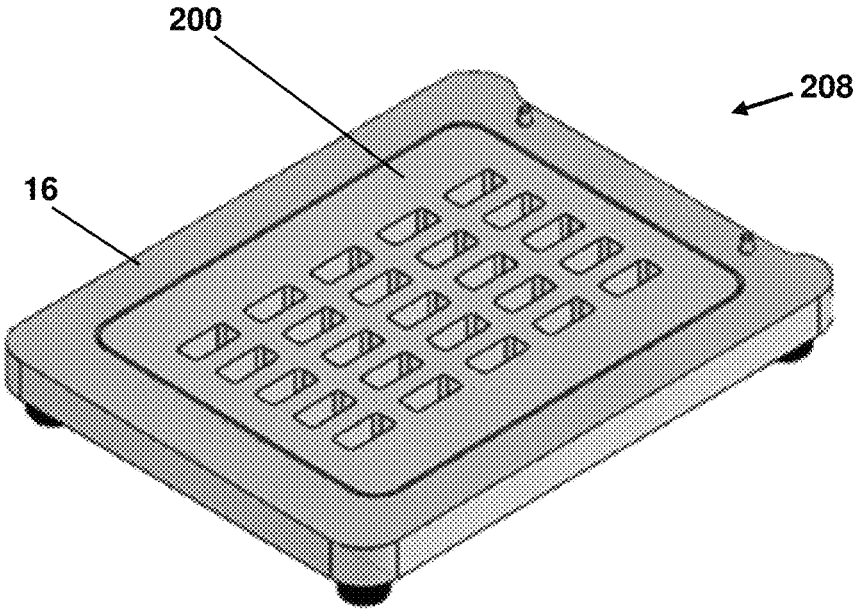
FIG. 34 is a side perspective view of an assembly of a base with the insert of FIG. 32.

Referring to FIGS. 32 and 33, an exemplary embodiment of an insert 200 for use with the blister pack array 188 of FIGS. 29-31 is shown. The insert 200 has a front surface 202 and a back surface 204. Twenty-five openings 206 correspond in shape and orientation to the blister cavities 192 of the blister pack array 188, such that the blister pack array 188 may be nested into the insert 200. The overall shape and dimensions of the insert 200 may correspond to the inner perimeter 38 of the front surface 32 of the base 16, such that the insert 200 may be placed on top of the recessed shelf 42. Referring to FIG. 34, an assembly 208 comprising the base 16 and the insert 200 is shown. It will be appreciated that the insert 200 can be interchangeable with other inserts in order to use the same base to apply labels to blisters of different shapes and sizes.

Figure 35:
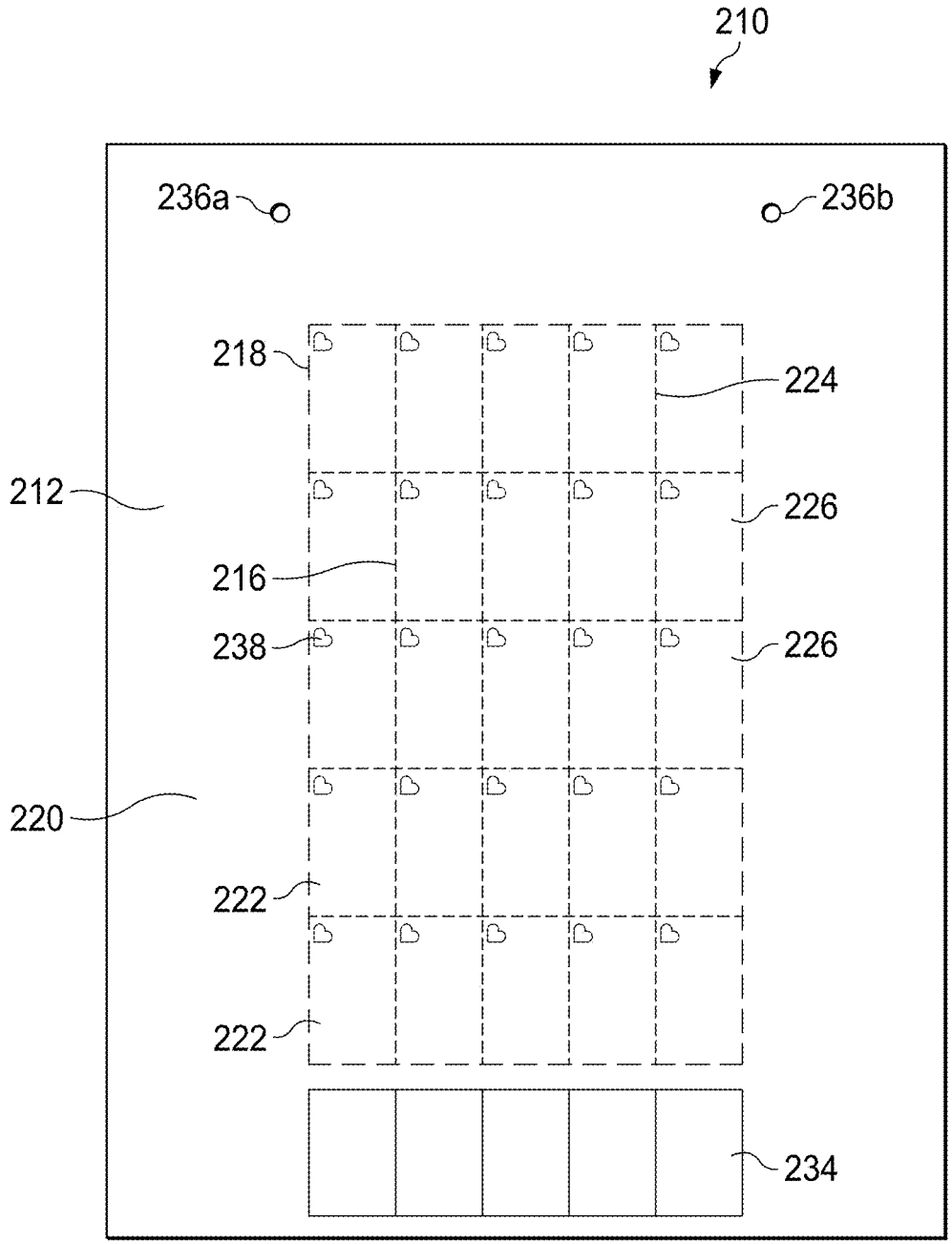
FIG. 35 is a top plan view of an exemplary embodiment of a label sheet.
Figure 36:
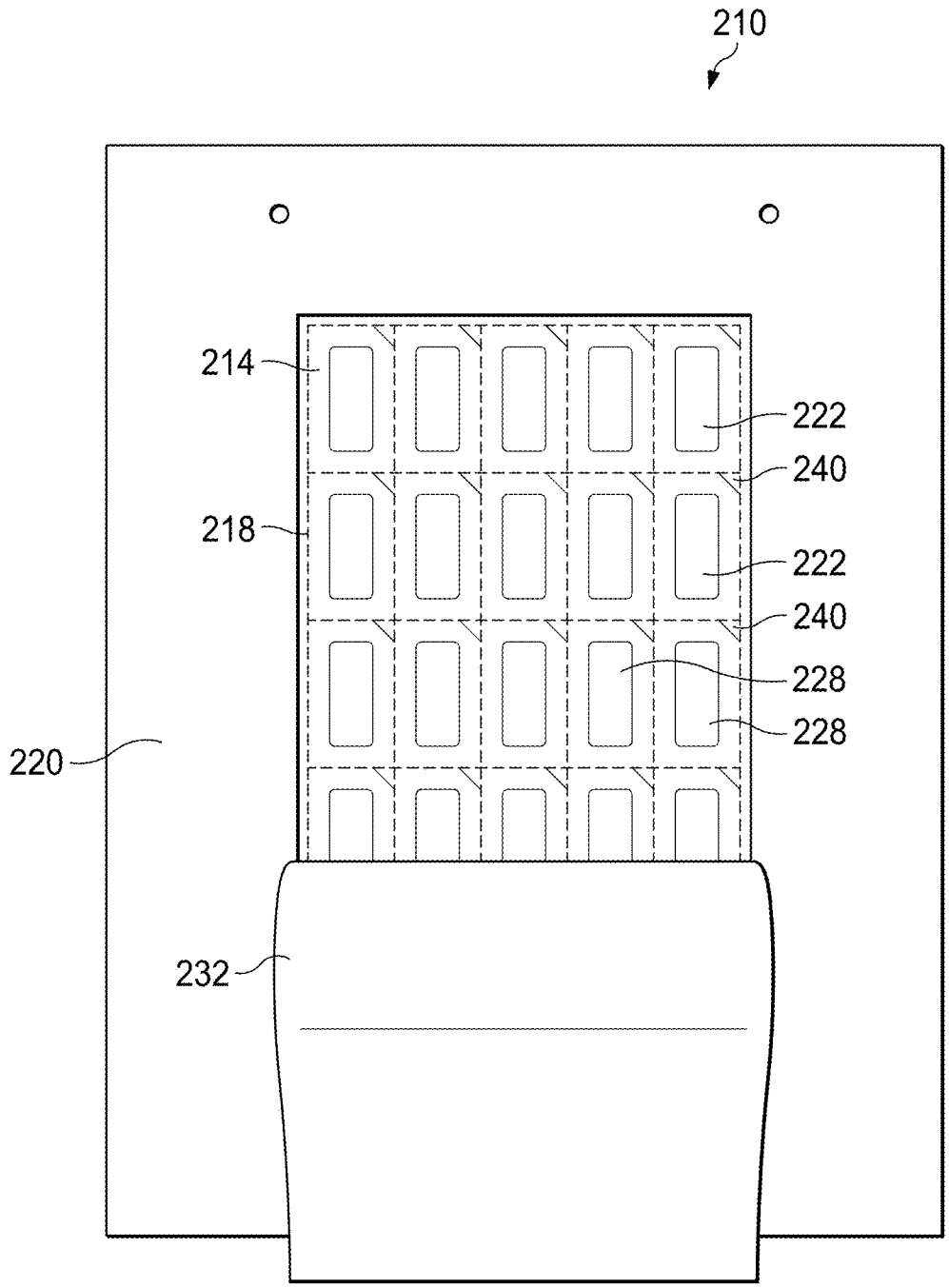
FIG. 36 is a bottom plan view of the label sheet of FIG. 35, with the back cover partially removed.

Referring to FIGS. 35 and 36, an exemplary embodiment of a label sheet 210 that corresponds with the blister pack array 188 of FIGS. 29-31 is shown. The label sheet has a front side 212 and a back side 214 and is generally sectioned into a blister portion 216 having an outer perimeter 218 and a frame portion 220 that surrounds the blister portion 216. The blister portion 216 is comprised of multiple labels 222 oriented in a 5×5 array. Each label 222 has a generally rectangular perimeter 224 that defines the label's front surface 226 and back surface 168. The back surface 228 of each label comprises an adhesive portion 230 that is sized and oriented to correspond with the shelf 194 of the blister pack array 188.

The label sheet 210 also comprises a removable back cover 232, appendix labels 234, and locator holes 236*a*, 236*b*. Also present on the front surface 226 of each label 222 is a visual icon 238 that corresponds to a bare corner portion 240 on the back surface 228. The label sheet 210 may be used as part of the same method described herein to apply the labels 222 to the blisters 190 and create sealed blister packs.

Figure 37:
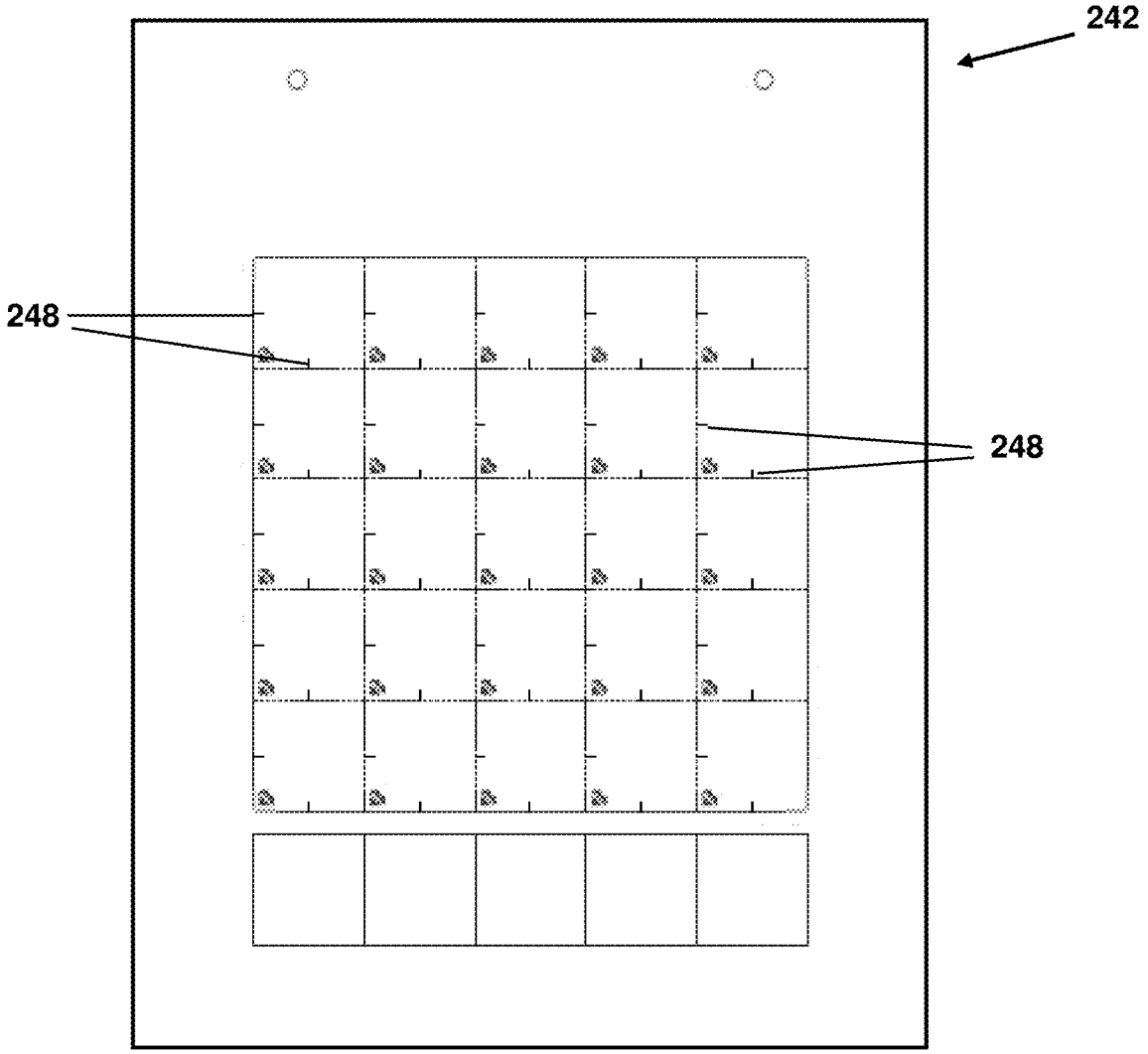
FIG. 37 is a top plan view of an exemplary embodiment of a label sheet for round blisters comprising tear slits on the labels.
Figure 38:
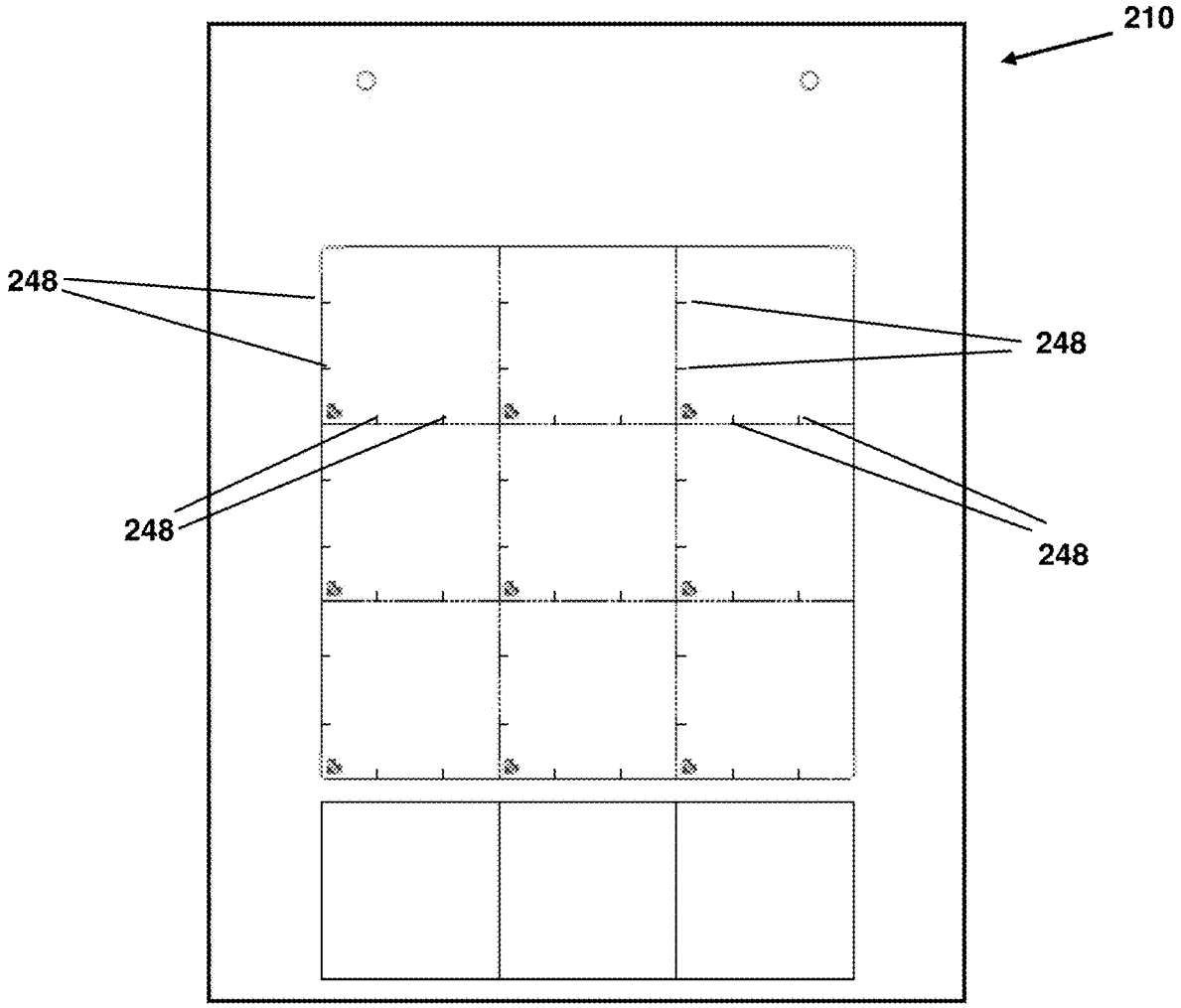
FIG. 38 is a top plan view of an exemplary embodiment of a label sheet for square blisters comprising tear slits on the labels.
Figure 39:
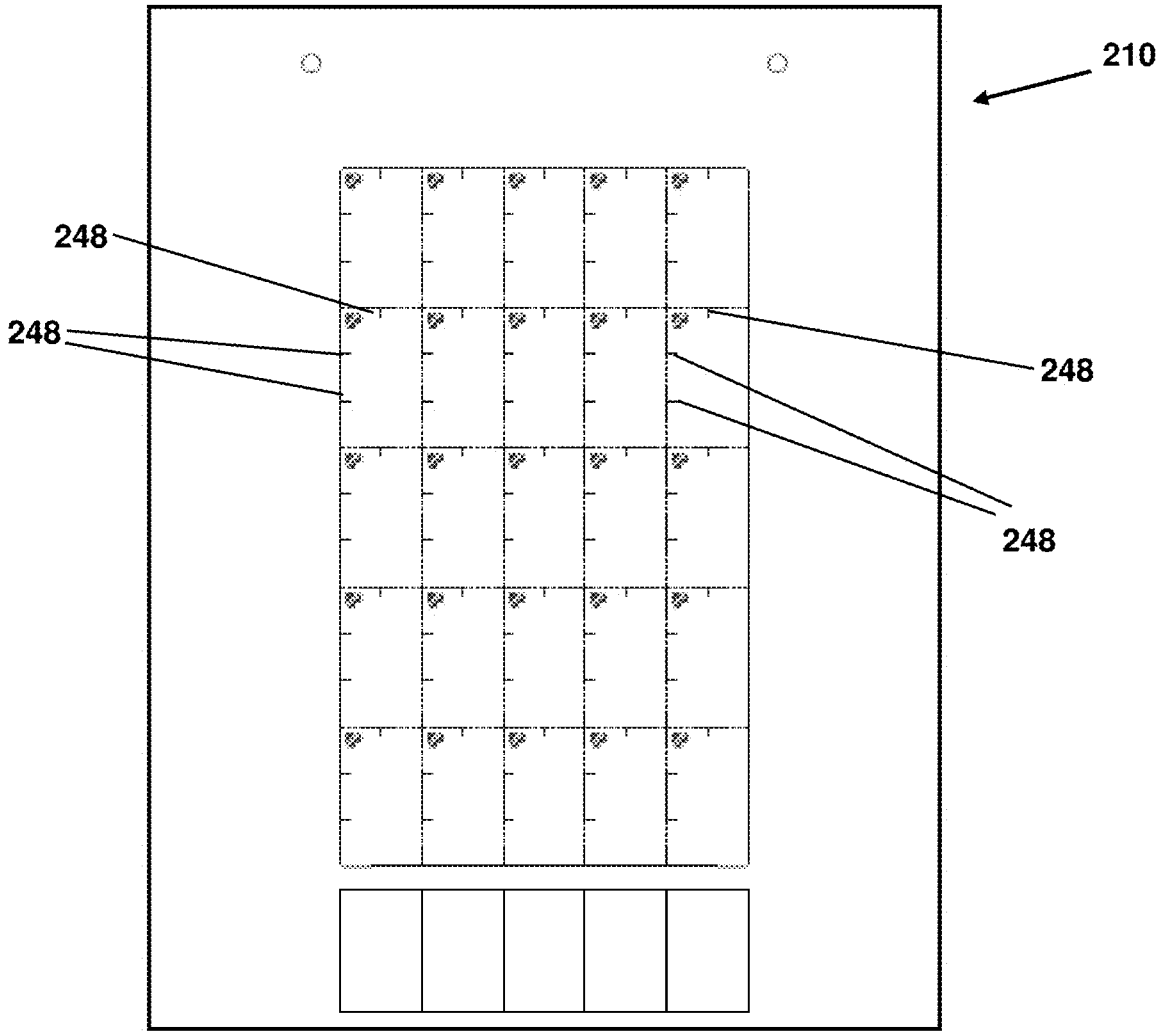
FIG. 39 is a top plan view of an exemplary embodiment of a label sheet for oblong blisters comprising tear slits on the labels.

Referring to FIGS. 37-39, exemplary embodiments of label sheets for round blisters 242, square blisters 244, and oblong blisters 246 are shown. These label sheets are similar to those depicted in FIGS. 14-15, 27-28, and 35-36 for similar blister shapes, yet further comprise tear slits 248 on the individual labels. A tear slit 248 may be a small cut or perforation on the label 248 that is directed inward from the perimeter. In the exemplary embodiments, the tear slit 248 is not long enough to extend beyond the adhesive portion, thereby maintaining the seal and safety of the contents of a sealed blister. However, when a user manipulates a pull point or otherwise attempts to remove a label from a sealed blister pack, even if done gently, the tear slit or slits may cause a significant tear in the label that provides a visual indicator of any attempted tampering with a blister. Tear slits may be used to help identify and prevent unwanted diversion of blister pack contents.

As depicted in FIGS. 37-39, depending on the size and shape of the labels, different numbers of tear slits may be present on individual labels, and the location of the tear slits may differ. It may be ideal for one or more tear slits to flank the corner of the label that comprises the bare corner portion. One or more slits may be present on any of the sides of the label. In other exemplary embodiments, other tamper evident features may also be used without departing from the scope of the inventive concepts herein.

Figure 40:
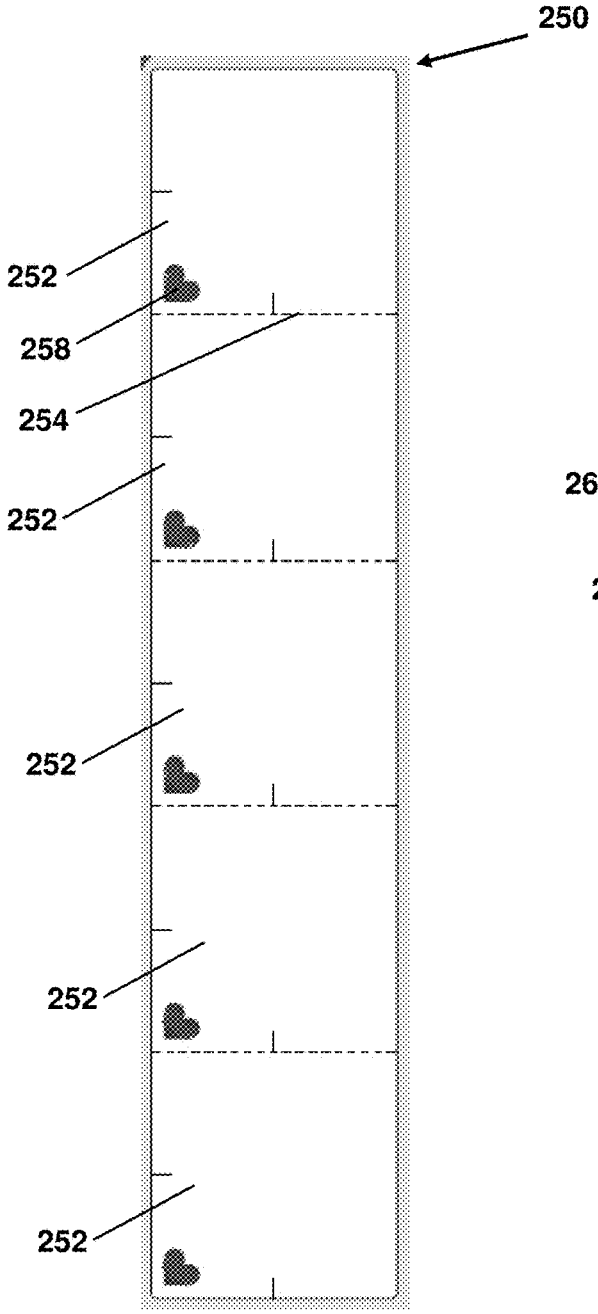
FIG. 40 is a top plan view of an exemplary embodiment of a strip of blister labels for round blisters.
Figure 41:
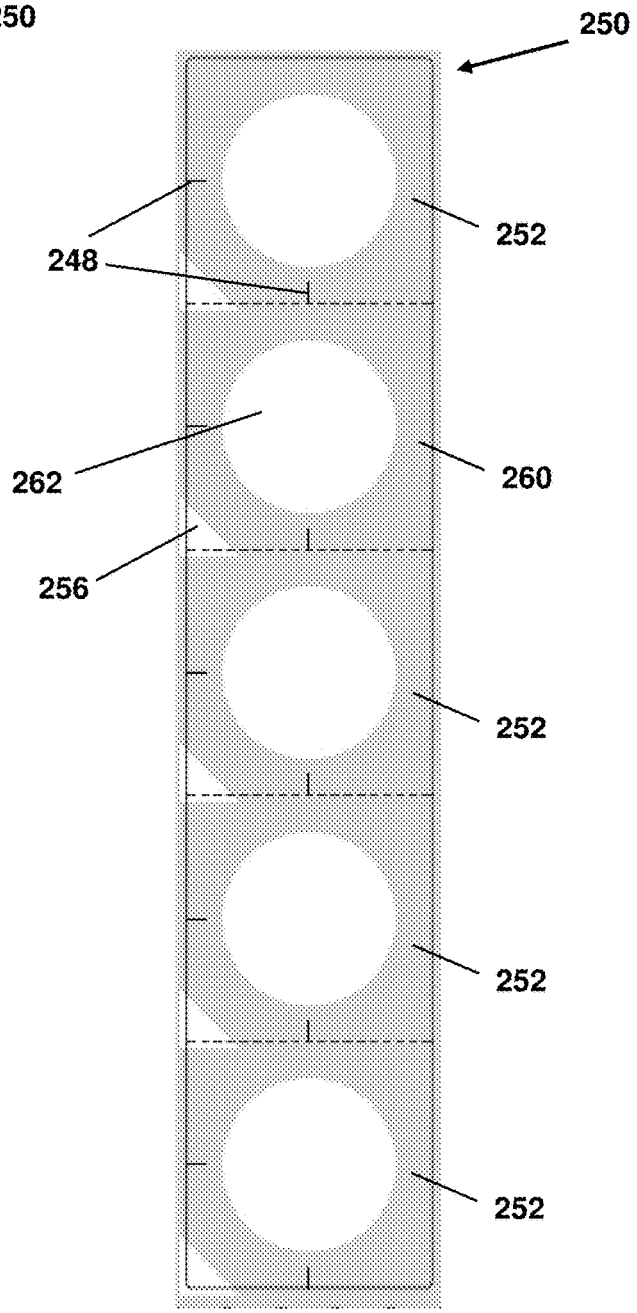
FIG. 41 is a bottom plan view of the strip of blister labels of FIG. 40.
Figure 42:
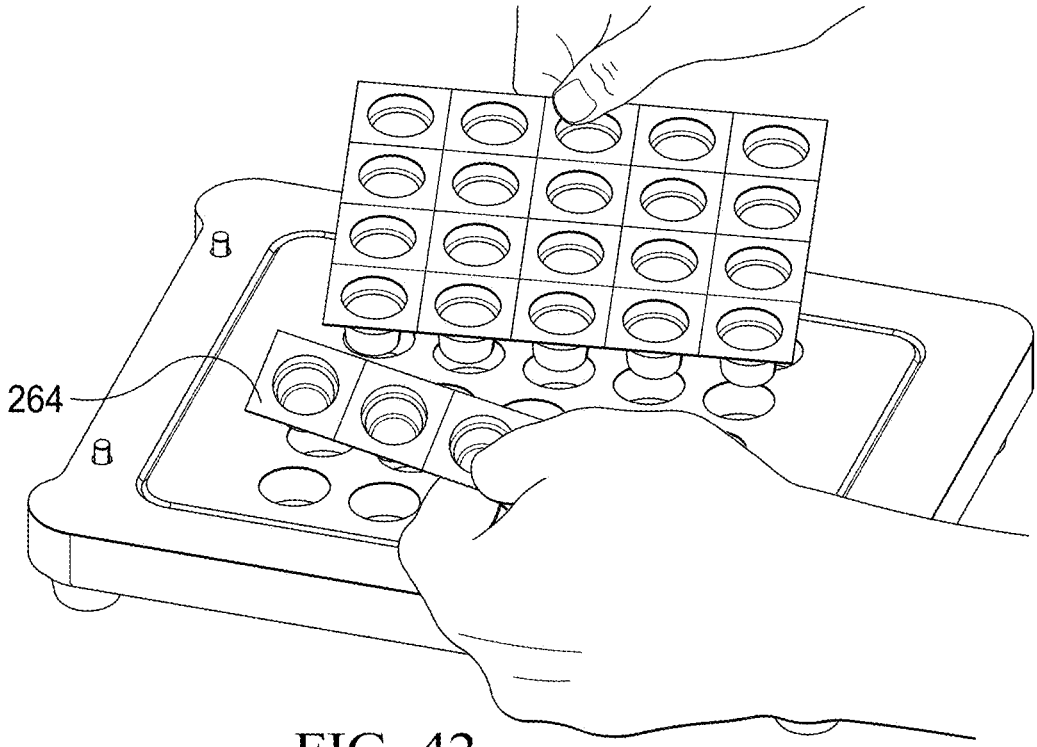
FIGS. 42-45 depict an exemplary method of creating a sealed blister pack strip.
Figure 43:
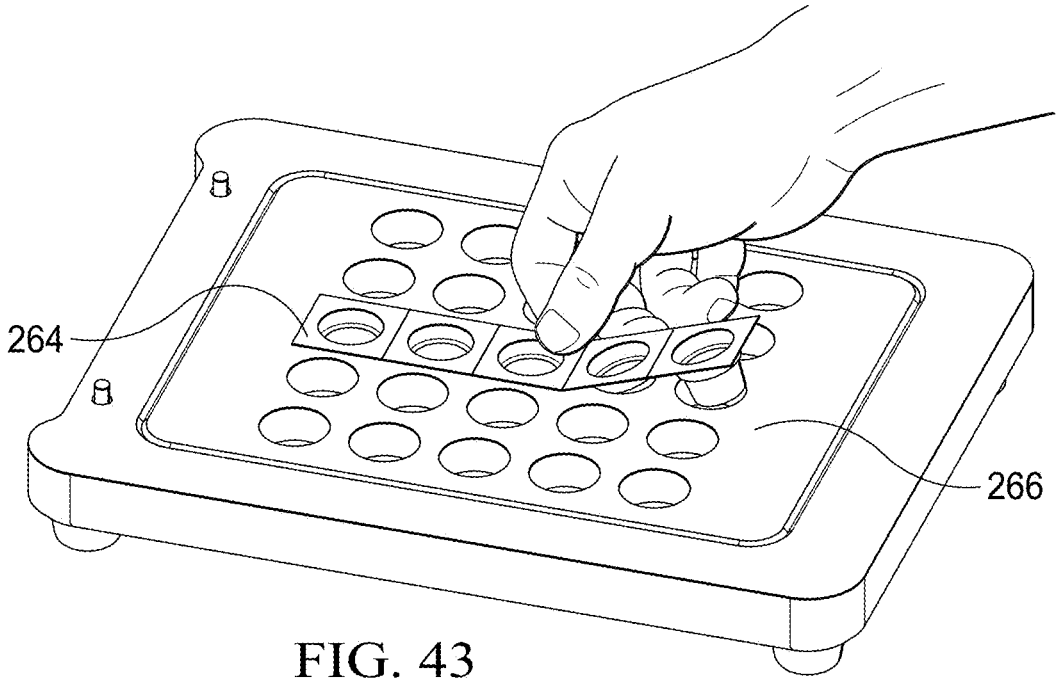

In an exemplary embodiment, labels and/or blisters may not be provided in an array but as individual labels or blisters, or, strips of labels or blisters. Packaging individual blisters or a strip of blisters may be desirable when a user only needs to create one or a few sealed blister packs. Printing thermal transfer labels from a roll often requires a smaller printer than printing label sheets, and may be preferrable in certain settings. Referring to FIGS. 40 and 41, an exemplary embodiment of a strip of thermal transfer labels 250 for round blisters is shown. The strip 250 is comprised of individual labels 252, and may be sectioned off from a larger roll of thermal transfer labels. Each label may be separated from the others through manipulation or tearing of the perforated borders 254 between the labels 252. Each label 250 may have a removable backing (not shown). In this exemplary embodiment, a single tear slit 248 is located on either side of the bare corner portion 256 of each label. The location of the bare corner portion 256 is identified on the front of each label 250 by a visual indicator 258. FIG. 41 depicts the back side of the label strip after the removable backing has been removed. The adhesive portion 260 surrounds a central bare portion 262, and the tear slits 248 extend inward from the sides but do not extend into the bare central portion 262.

Figure 44:
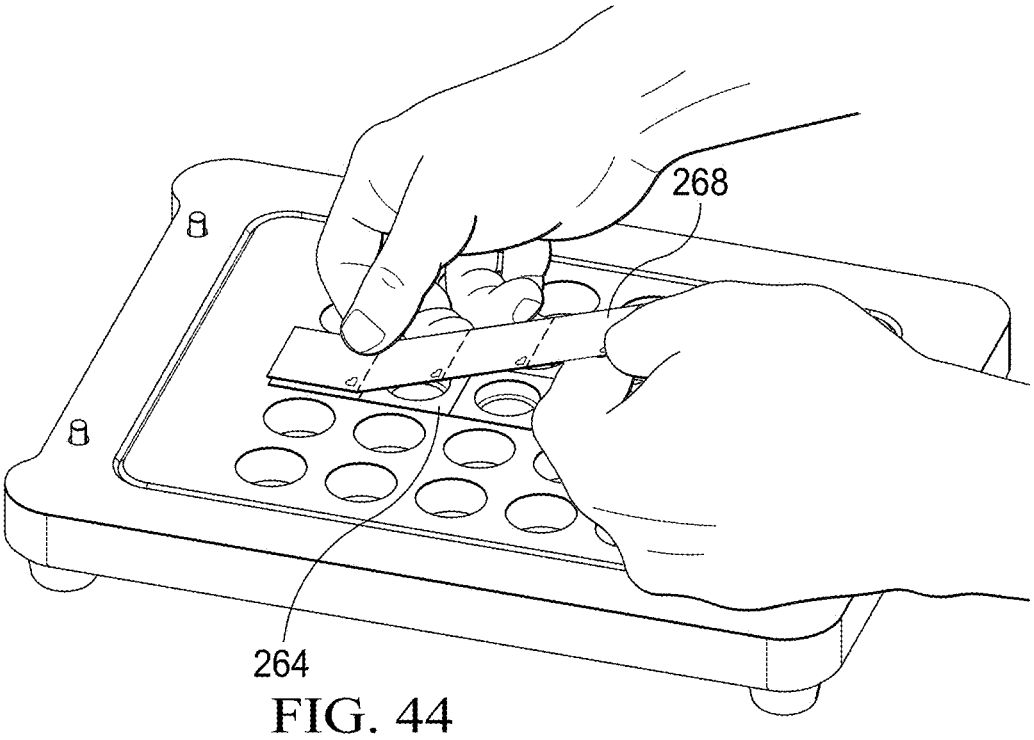
Figure 45:
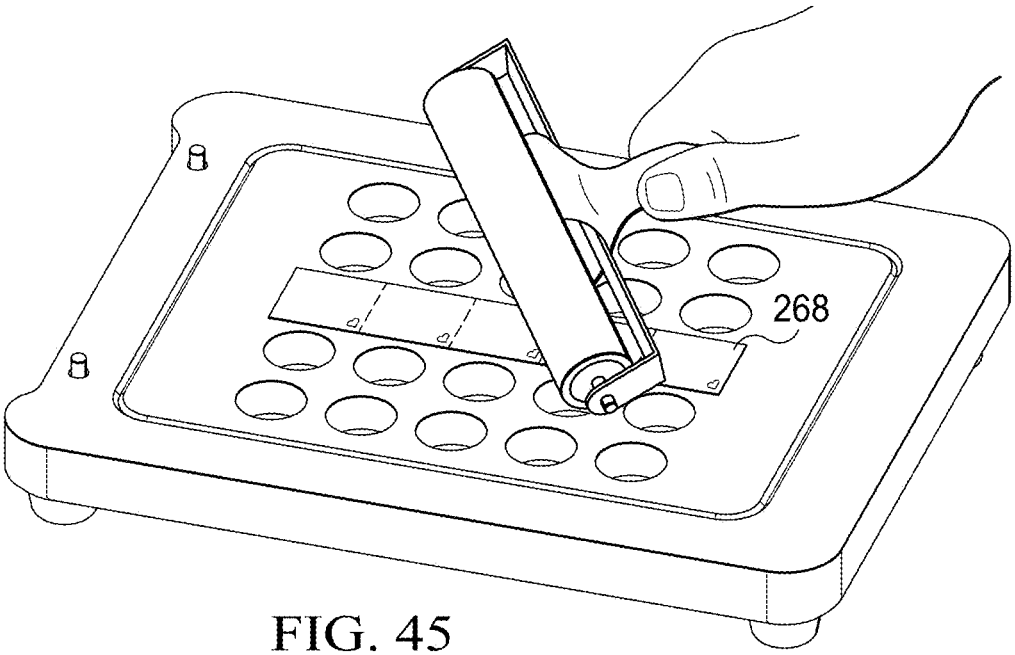

Referring to FIGS. 42-45, steps of an exemplary embodiment of a method for sealing a strip of blisters is depicted. First, with reference to FIG. 42, a user obtains a strip of blisters 264 containing a desired amount of individual blisters. The strip 264 may be obtained by separating the strip from a larger strip, or from a larger array. Next, and with reference to FIG. 43, the strip of blisters 264 is nested into a corresponding insert 266. Desired contents are placed into the blisters. A strip of labels 268 corresponding in number to the number of blisters on the blister strip 264 is obtained, and the removable backing(s) are fully removed from the labels in order to expose the adhesive portion on the back of each label. Referring to FIG. 44, the labels 268 are aligned on top of the blister strip 264. Next, and with reference to FIG. 45, pressure is applied to the top surface of the labels 268 to create a seal between the labels 268 and the blisters in the blister strip 264. The resulting strip of sealed blisters may thereafter be separated into individual sealed blisters if desired, and used or stored for use at a later time.

While the insert 266 is shown in the base, it will be appreciated by one of ordinary skill in the art that the insert 266 could also be used in a similar manner without the base.

In an exemplary embodiment, a base and more than one insert may be provided as a kit. For example, a kit may contain a base and three different inserts, each of which is designed to be used with a blister pack of a common shape. In yet other exemplary embodiments, a kit may also include label sheets and blister pack arrays, in addition to a base and inserts. One of ordinary skill in the art will appreciate that various items may be packaged together to form kits capable of packaging blisters of one or more different sizes and shapes.

In an exemplary embodiment, blister arrays may be thermoformed or otherwise molded using a female tool. Utilizing female tooling to form blisters allows for the top side of the blisters to remain free and untouched from release agents that are often applied to thermoform tooling in order to prevent formed blister arrays from sticking to the molds after they are fully formed. Utilizing female tooling allows for a better adhesive connection with the top surfaces of the blister array (since they have not been in contact with release agents). A better adhesive connection results in a better seal on packaged labels, and better protection against moisture or other environmental factors.

Figure 46:
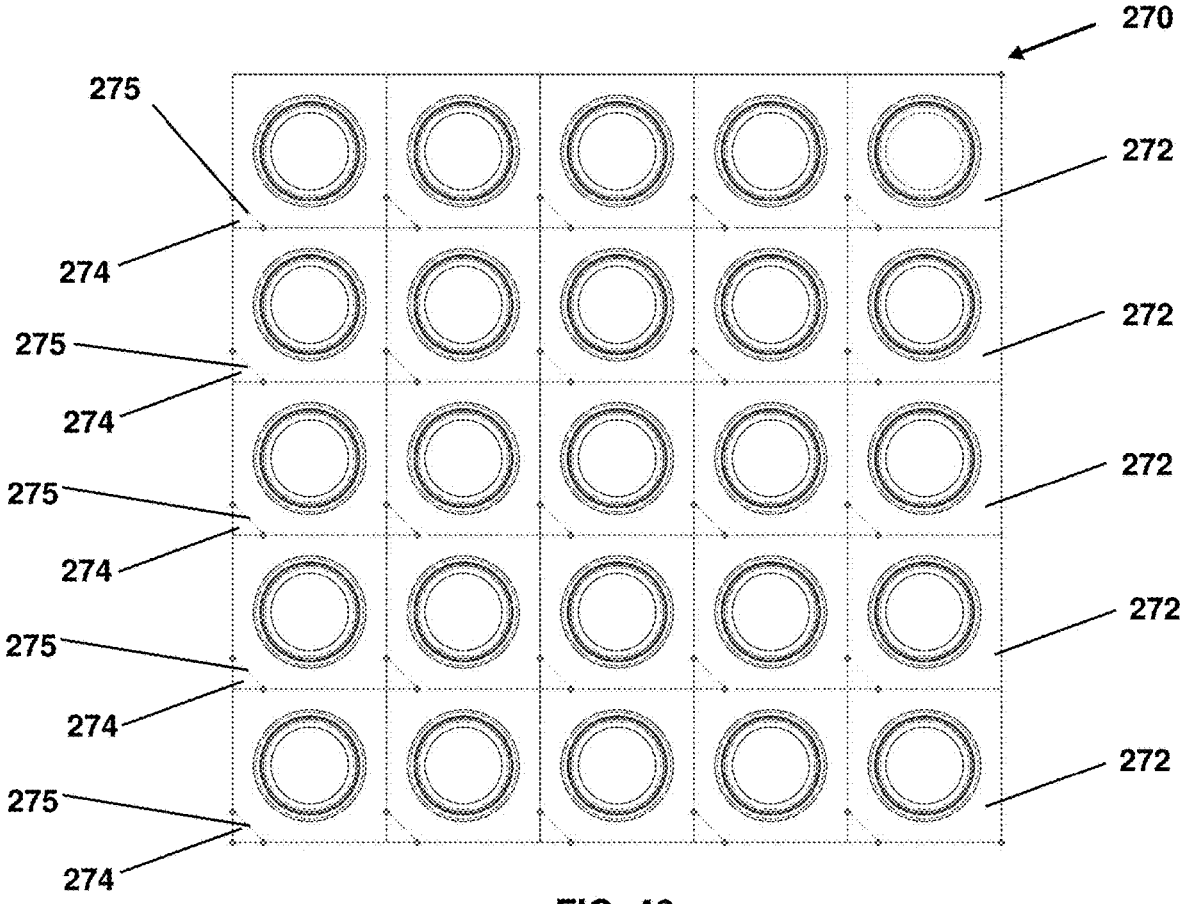
FIG. 46 is a top plan view of an exemplary embodiment of a round blister pack array with die-cut corners.
Figure 47:
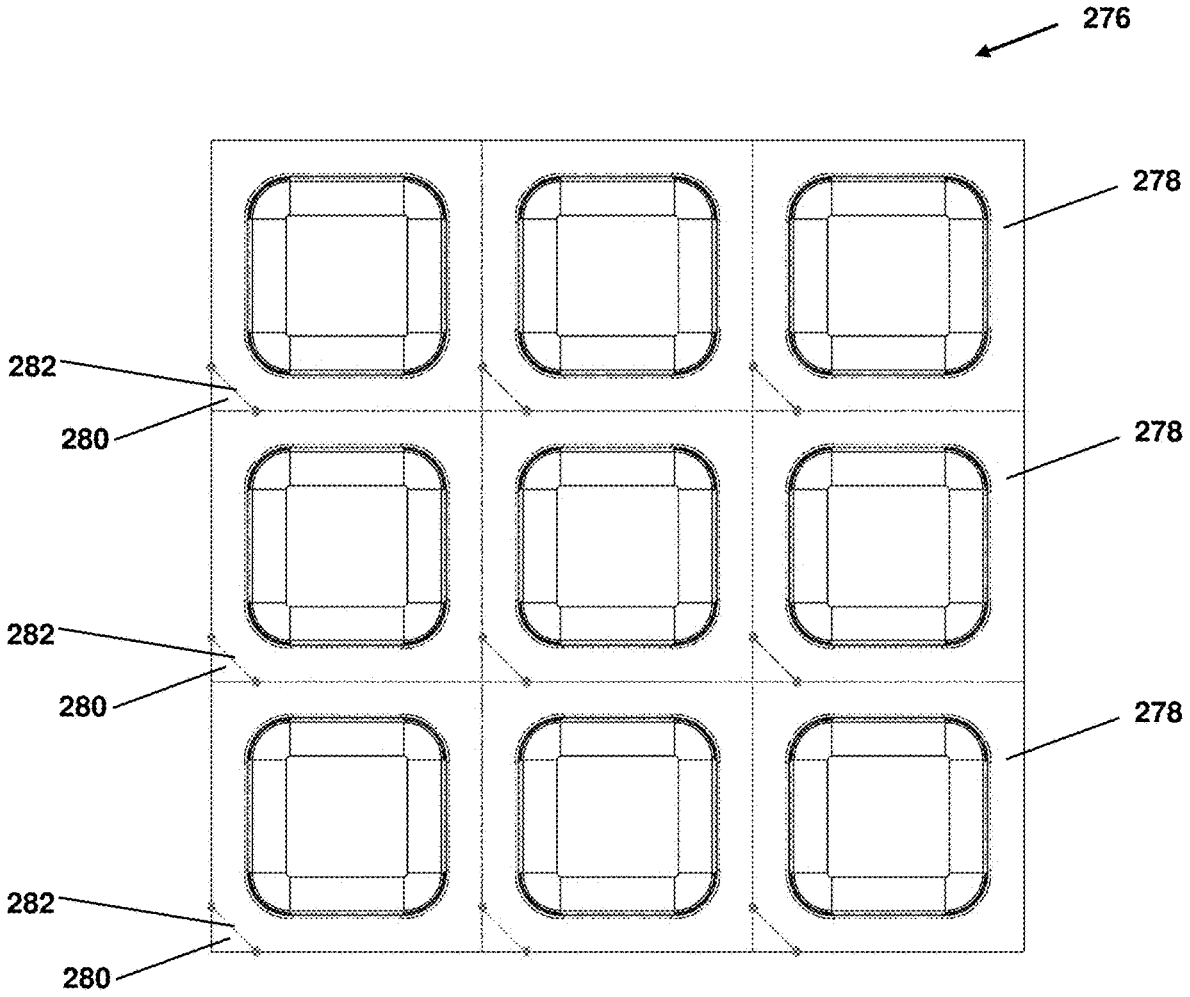
FIG. 47 is a top plan view of an exemplary embodiment of a square blister pack array with die-cut corners.
Figure 48:
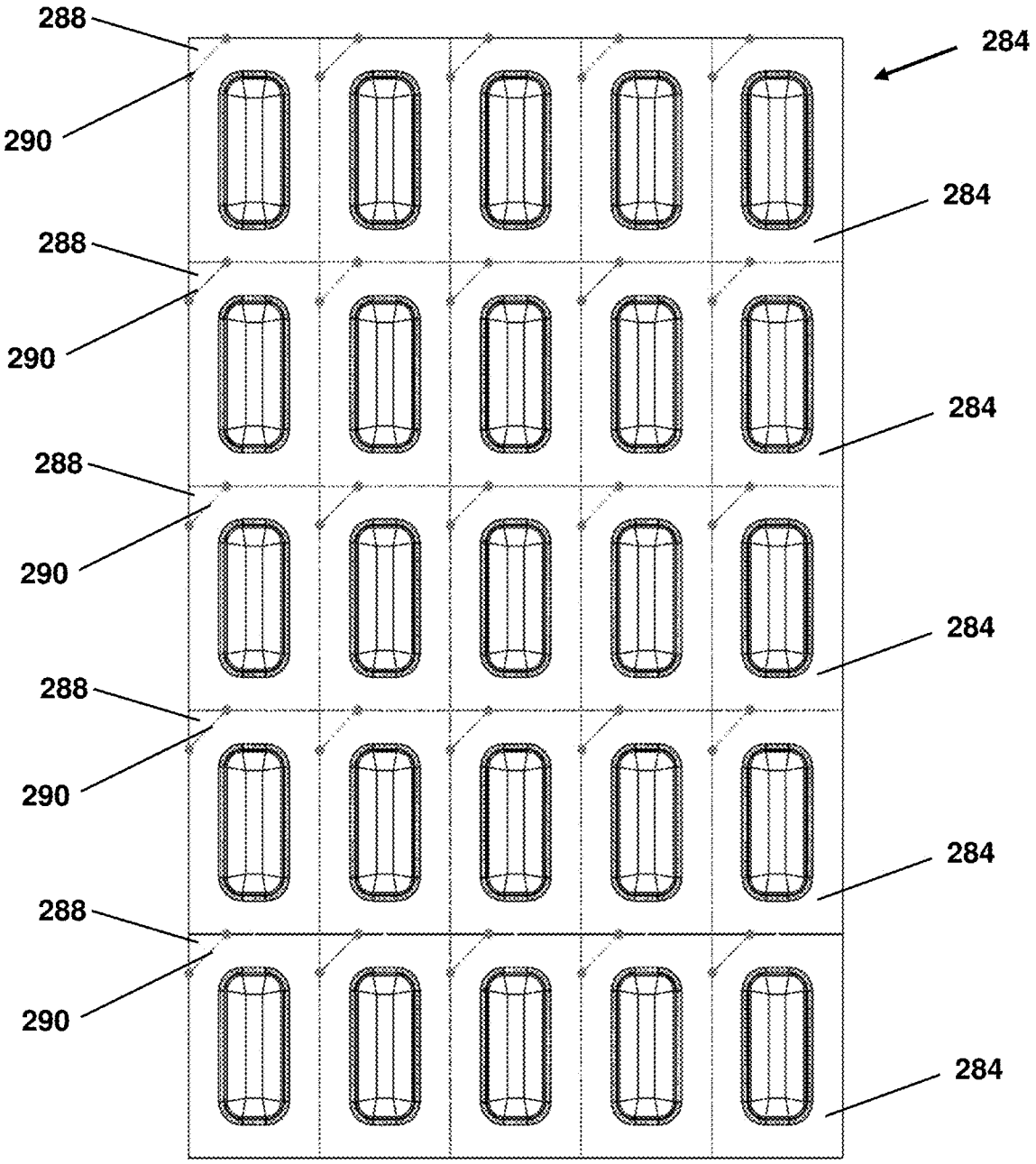
FIG. 48 is a top plan view of an exemplary embodiment of an oblong blister pack array with die-cut corners.

In an exemplary embodiment, one or more blisters in a larger blister array may have one or more corners that have been die-cut, scoured, or perforated in order to make it easier for the one or more corners to be bent and aid in the ability of a user to manipulate a corner portion of a corresponding label and initiate peeling off the label. Referring to FIG. 46, an exemplary embodiment of a round blister pack array 270 is shown wherein each individual blister 272 has a single die-cut corner 274 formed from a cut line 275. The die-cut corners 274 are located on the same corner of each blister 272, and may correspond with the location of bare corner portions of each label on a corresponding label sheet. FIG. 47 is an exemplary embodiment of a square blister pack array 276 wherein each individual blister 278 has a single die-cut corner 280 formed by a cut line 282. FIG. 48 is an exemplary embodiment of an oblong blister pack array 284 wherein each individual blister 286 has a single die-cut corner 288 formed by a cut line 290.

While the exemplary embodiments disclosed herein describe the best modes known to the inventors at the time of filing, the scope of the invention is not intended to be limited to only the embodiments disclosed herein.

The invention claimed is:

1. A system for packaging blister labels, wherein the system comprises:

a base, said base comprising:

a top side with a top surface having an inner perimeter and a bottom side;

a central opening;

a recessed shelf surrounding at least a portion of said central opening, said recessed shelf located between and defined by said inner perimeter of said top surface and an opening perimeter; and a pair of locator pins extending outward from said top surface;

an insert configured to receive a blister pack array, said insert having a generally planar body, a top side with a top surface, a bottom side, and a plurality of openings, said insert adapted to be removably placed onto said recessed shelf and cover said central opening;

wherein the depth of said recessed shelf and the thickness of said insert are substantially similar, and the length of an outer perimeter of said insert and said inner perimeter of said top surface are substantially similar.

2. The system of claim 1, wherein said plurality of openings of said insert are positioned in an array of columns and rows.

3. The system of claim 2, wherein said plurality of openings are round.

4. The system of claim 2, wherein said plurality of openings are square.

5. The system of claim 1, wherein said base is generally rectangular in shape with four corners, and further comprises a foot extending from said bottom side of said base at each of said four corners.

6. The system of claim 1, wherein said base further comprises two protrusions extending outward from two neighboring corners.

7. The system of claim 6, wherein said pair of locator pins are located in between said two neighboring corners.

8. A method of packaging blister labels, comprising the steps of:

obtaining a base, said base having:

a top side with a top surface having an inner perimeter and a bottom side;

a central opening;

a recessed shelf surrounding at least a portion of said central opening;

a pair of locator pins extending outward from said top surface;

obtaining a blister pack array, said blister pack array comprised of a plurality of individual blisters with uniform blister cavities, said plurality of individual blisters having perforated outer perimeters;

selecting an insert adapted to receive said blister pack array, said insert having a plurality of holes of uniform shape, wherein the number of said plurality of holes is no less than the number of said plurality of individual blisters, and said uniform shape of said plurality of holes corresponds to the shape of said uniform blister cavities;

nesting said blister pack into said insert, after said insert has been removably placed onto said recessed shelf in said central opening of said base;

selecting a label sheet, said label sheet comprising a central blister portion with a plurality of individual labels and a perforated perimeter, an outer frame portion surrounding said blister portion, and a pair of locator holes, wherein each of said individual labels has a back surface with an adhesive portion;

anchoring said label sheet into a fixed orientation relative to said base and insert by inserting said locator pins through said locator holes;

applying downward pressure to the top surface of said label sheet until said adhesive portions of said plurality of individual labels bond to said plurality of individual labels, forming a packaged blister array comprised of individual sealed blisters;

removing said outer frame portion from said packaged blister array by pulling upwards on said outer frame portion and tearing along said perforated perimeter; and removing said packaged blister array from said insert.

9. The method of claim 8, further comprising the step of separating each of said individual sealed blisters in said packaged blister array.

10. The method of claim 8, wherein said step of applying downward pressure occurs after said blister cavities have been filled with one or more items.

* * * * *